US010556737B2

(12) United States Patent
Johanson et al.

(10) Patent No.: US 10,556,737 B2
(45) Date of Patent: Feb. 11, 2020

(54) TWIST ACTION PORTION CONTROL SAUCE DISPENSER

(71) Applicant: SONOCO DEVELOPMENT, INC., Hartsville, SC (US)

(72) Inventors: James Eric Johanson, Brainard, NY (US); Chad E. Lagace, Hartsville, SC (US)

( * ) Notice: Subject to any disclaimer, the term of this patent is extended or adjusted under 35 U.S.C. 154(b) by 0 days.

(21) Appl. No.: 16/271,093

(22) Filed: Feb. 8, 2019

(65) Prior Publication Data

US 2019/0248574 A1 Aug. 15, 2019

Related U.S. Application Data

(60) Provisional application No. 62/628,712, filed on Feb. 9, 2018.

(51) Int. Cl.
*B65D 83/00* (2006.01)

(52) U.S. Cl.
CPC ..... *B65D 83/0011* (2013.01)

(58) Field of Classification Search
CPC ..... B65D 83/0011; B65D 83/0072; B05C 17/012; B05C 17/0133; A47G 19/183
USPC ..... 222/39, 390, 391, 522–525, 489, 503, 222/379, 432, 434, 452, 453, 457.5; 401/75, 172–175
See application file for complete search history.

(56) References Cited

U.S. PATENT DOCUMENTS

| | | | | |
|---|---|---|---|---|
| 5,992,705 | A * | 11/1999 | Lhuisset | A45D 40/04 222/386 |
| 7,213,994 | B2 | 5/2007 | Phipps et al. | |
| 7,946,780 | B2 * | 5/2011 | Zhang | A45D 34/042 401/175 |
| 9,248,948 | B2 * | 2/2016 | Penfold | G01F 11/025 |
| 9,897,475 | B2 * | 2/2018 | Penfold | G01F 11/025 |

(Continued)

FOREIGN PATENT DOCUMENTS

| | | |
|---|---|---|
| DE | 29721846 | 2/1998 |
| WO | WO 2014/121250 | 8/2014 |

OTHER PUBLICATIONS

International Search Report and Written Opinion for Application No. PCT/US2019/017220 dated May 27, 2019.

*Primary Examiner* — Lien M Ngo
(74) *Attorney, Agent, or Firm* — Nelson Mullins Riley & Scarborough, LLP

(57) ABSTRACT

A dispensing device having an elongated dispenser body which is elliptical in cross-section through its midsection, has an open top end, and has a dispensing bottom end; a cylindrical ratchet support member which is removably disposed within the open top end of the dispenser body, wherein the ratchet support member comprises a through hole one and or more ribs disposed on the inside of its circumferential sidewall; and a wheel-shaped ratchet which is removably disposed within the ratchet support member, wherein the ratchet has radially extending teeth which are configured to engage with the ratchet support member ribs, the ratchet configuration allows rotary motion in a first direction over the ribs, the ratchet configuration prevents rotary motion in a second, opposite direction past a point defined by the ribs, and the ratchet comprises ribs disposed on the top surface of the ratchet wheel.

26 Claims, 30 Drawing Sheets

(56) References Cited

U.S. PATENT DOCUMENTS

| | | | | |
|---|---|---|---|---|
| 2007/0274768 | A1* | 11/2007 | Hines | A47L 25/08 401/265 |
| 2014/0221945 | A1* | 8/2014 | Dos Santos | A61M 35/003 604/311 |
| 2017/0209896 | A1* | 7/2017 | Phipps | A61M 35/003 |
| 2017/0247170 | A1* | 8/2017 | Bilton | A45D 34/04 |
| 2018/0086541 | A1* | 3/2018 | Ellsworth | A45D 40/04 |
| 2018/0178968 | A1* | 6/2018 | Phipps | A45D 40/00 |
| 2018/0207413 | A1* | 7/2018 | Skakoon | A61M 35/003 |
| 2019/0255560 | A1* | 8/2019 | Phipps | A45D 34/04 |

* cited by examiner

TWIST ACTION PORTION CONTROL SAUCE DISPENSER

CROSS-REFERENCE TO RELATED APPLICATIONS

This application claims the benefit of U.S. Provisional Application No. 62/628,712 entitled "Twist Action Portion Control Sauce Dispenser," filed Feb. 9, 2018, which is incorporated herein in its entirety.

FIELD OF THE INVENTION

The present invention relates generally to dispensers for sauces, flowable foods, and other products, as well as methods for using such dispensers.

BACKGROUND

Restaurants and food service establishments often apply various food sauces to sandwiches, meats, desserts, and many other food products. For example, ketchup, mayonnaise, or mustard may be repeatedly applied to hamburgers or cold cut sandwiches in such a restaurant. Similarly, salad dressing may be repeatedly applied to salads. These and other sauces must be dispensed frequently and repeatedly in carefully controlled portions to ensure consistency in the foods served. In many cases, the amount of sauce that is to be dispensed to each individual meal must be of a relatively small volume. In addition, many restaurant kitchens have limited storage and maneuverability space and, therefore, the dispensing device must be easy to use, convenient to store, and maneuverable within the confines of a small kitchen or food prep area.

The conventional solution to repetitive restaurant saucing has been to package sauces in cartridges from which the sauces are dispensed using hand held dispensing guns, similar to caulking guns. The amount of sauce that is dispensed is typically controlled by providing a valve in the dispensing end of the cartridge and advancing the gun plunger against a movable plug within the cartridge a consistent distance each time the dispensing gun trigger is squeezed. The plunger's movement against the plug causes a measured amount of sauce to be extruded out of the valve at the end of the cartridge.

The caulk-like gun dispenser has disadvantages, however. The gun dispenser requires a long rod attached to its plunger, which takes up a lot of space in the kitchen and is difficult to maneuver in tight spaces. In addition, the sauce cartridges are bulky and require storage space in the kitchen. Likewise, the sauce cartridges become waste after use and are bulky to dispose of. Lastly, the amount of sauce to be dispensed is not accurately adjustable. Through much ingenuity and hard work, however, the inventors have developed a dispenser that allows controlled, consistent, and adjustable portioning of sauces and semi-solid products without the need for a bulky, wasteful dispensing guns, cartridges, and related components.

BRIEF DESCRIPTION OF THE DRAWING(S)

Having thus described the disclosure in general terms, reference will now be made to the accompanying drawings, which are not necessarily drawn to scale, and wherein:

DETAILED DESCRIPTION

Figure 1:
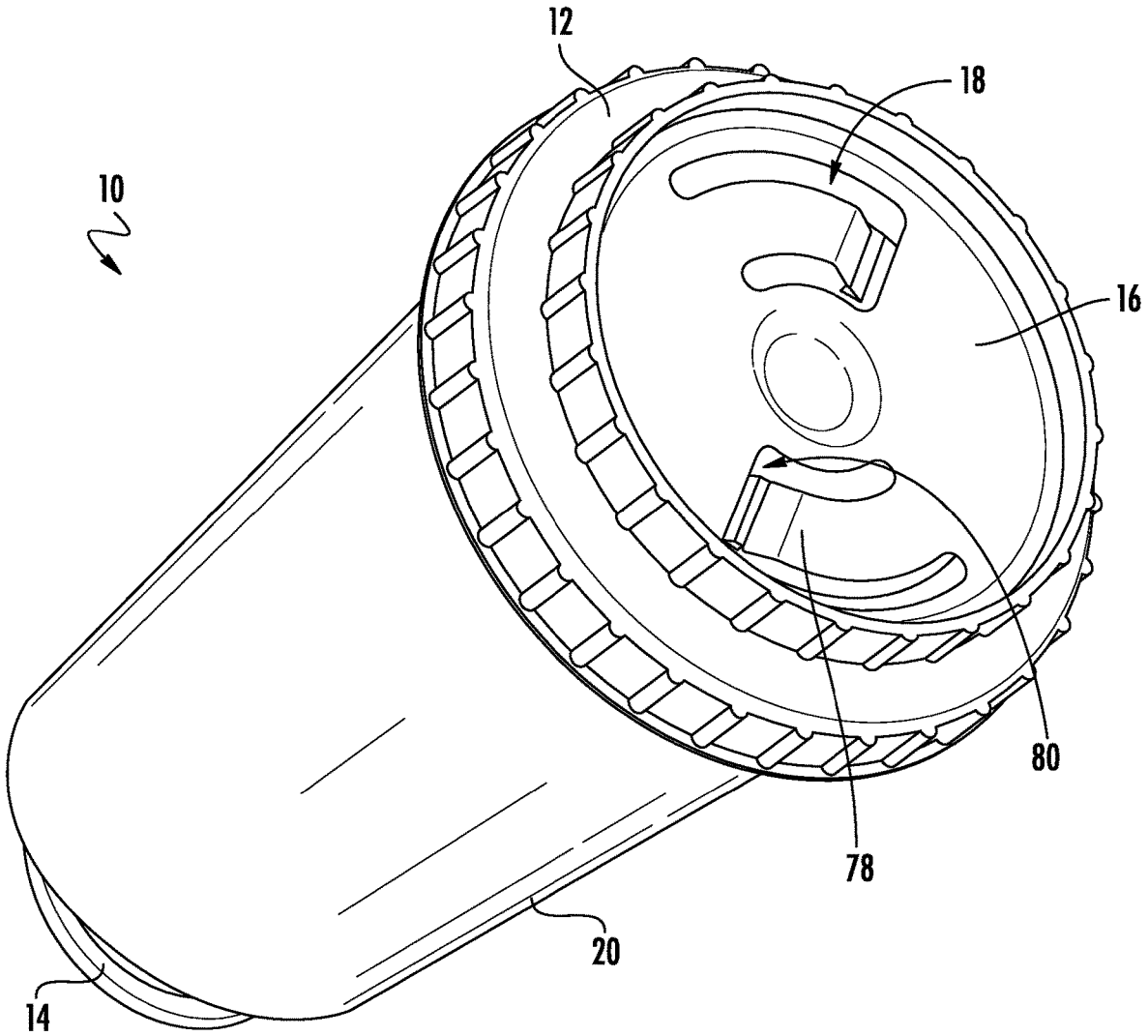
FIG. 1 is a top perspective view of the dispensing device in an embodiment of the invention.
Figure 2:
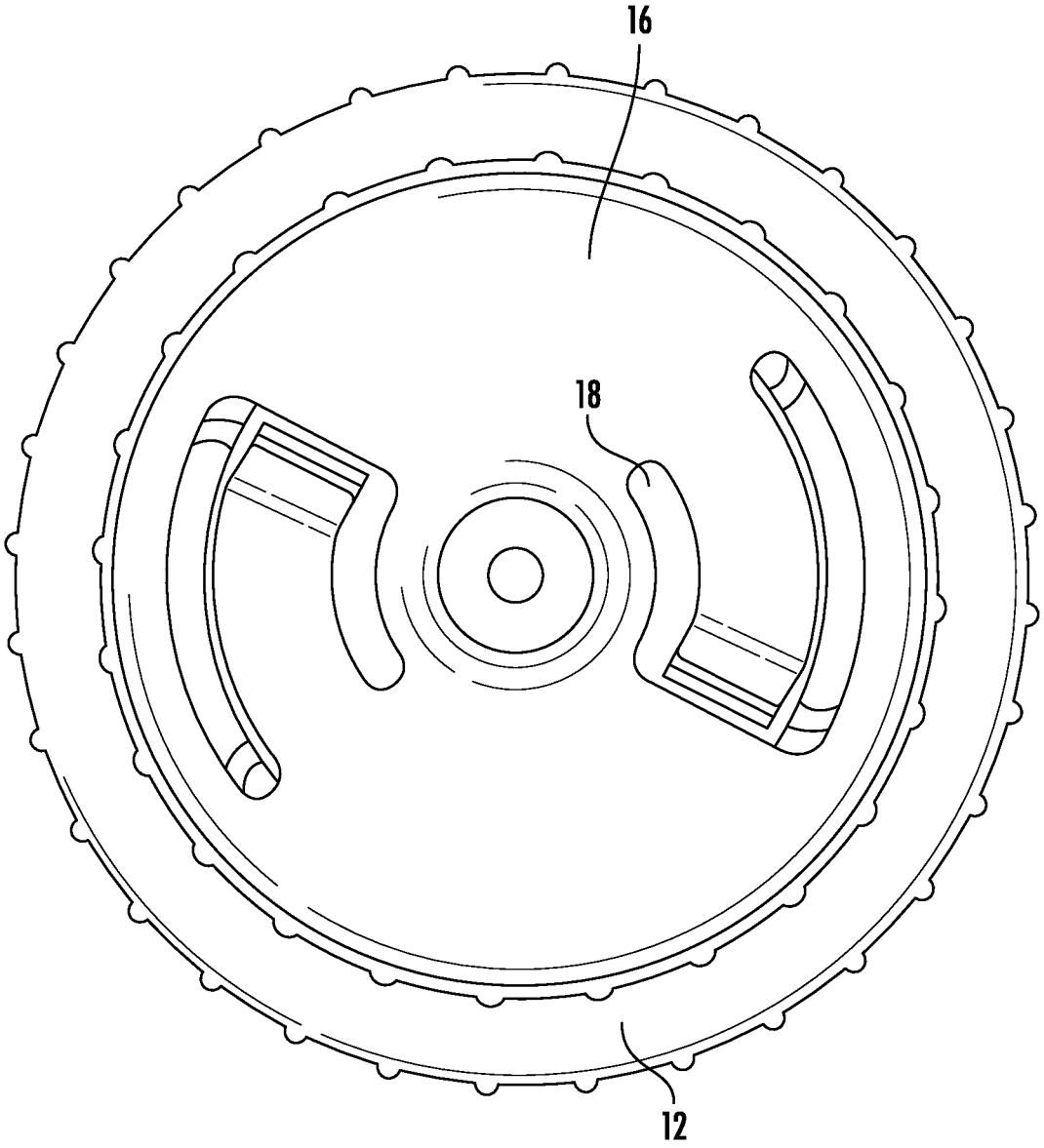
FIG. 2 is a top view of the dispensing device in an embodiment of the invention.
Figure 3:
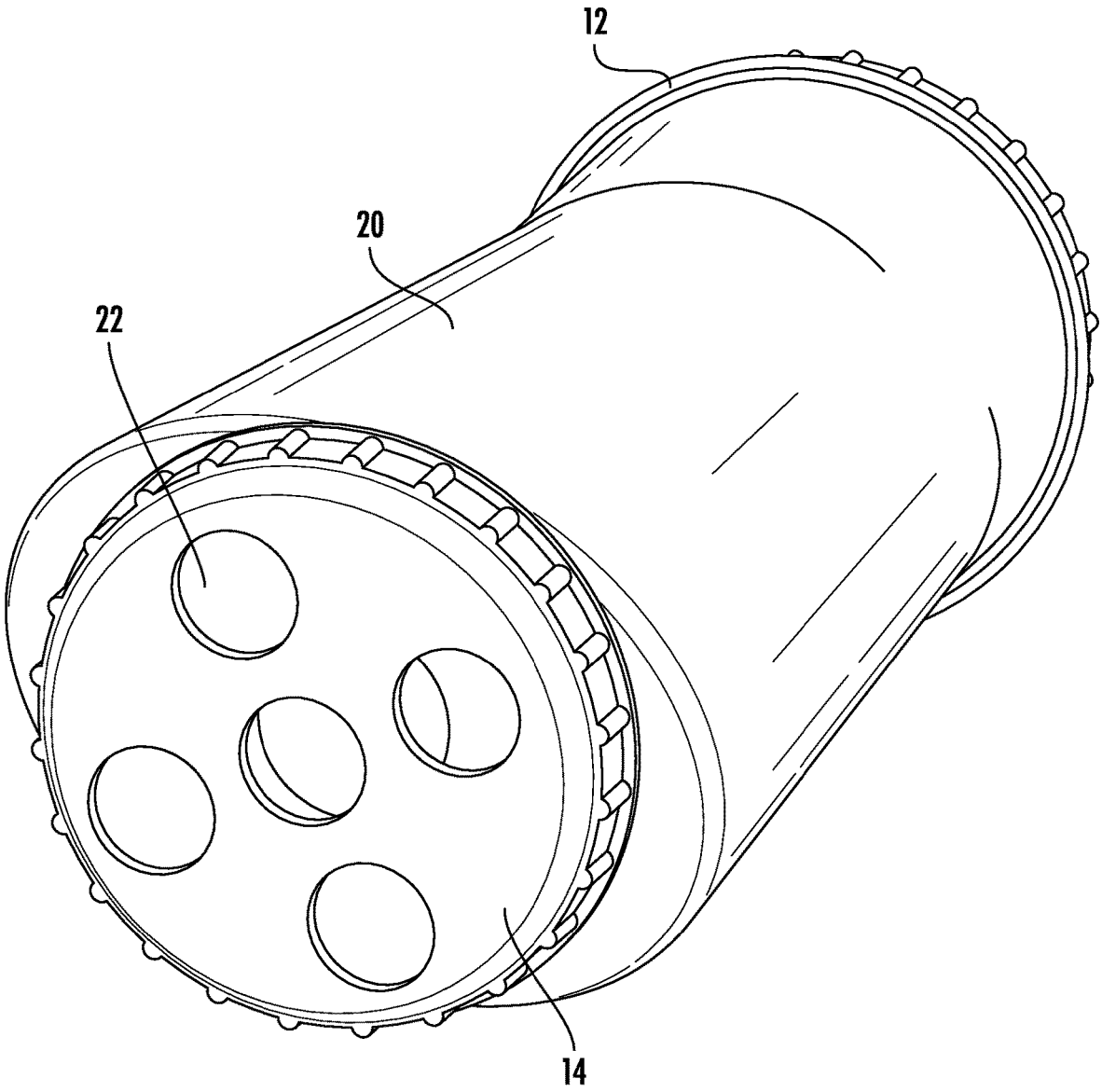
FIG. 3 is a bottom perspective view of the dispensing device in an embodiment of the invention.
Figure 4:
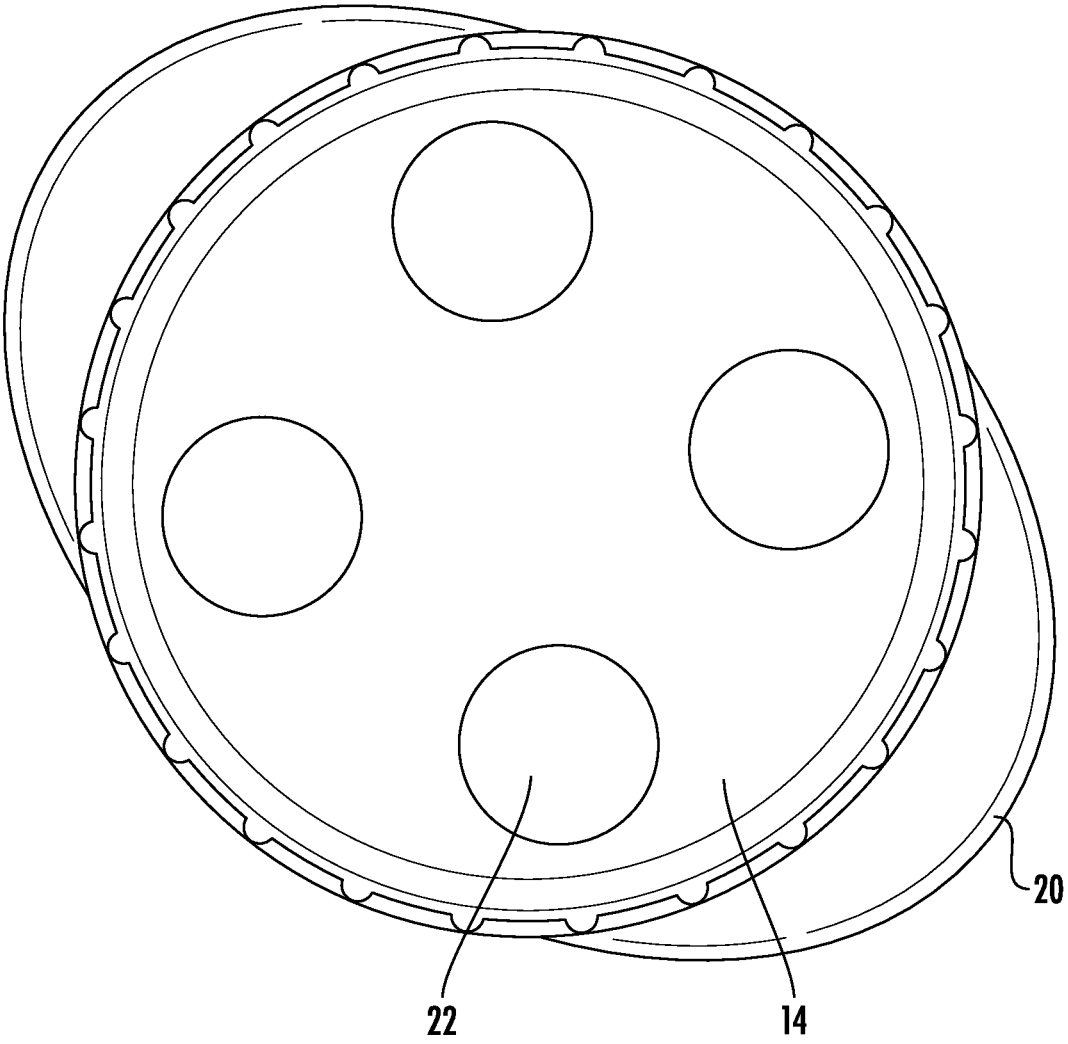
FIG. 4 is a bottom view of the dispensing device in an embodiment of the invention.
Figure 5:
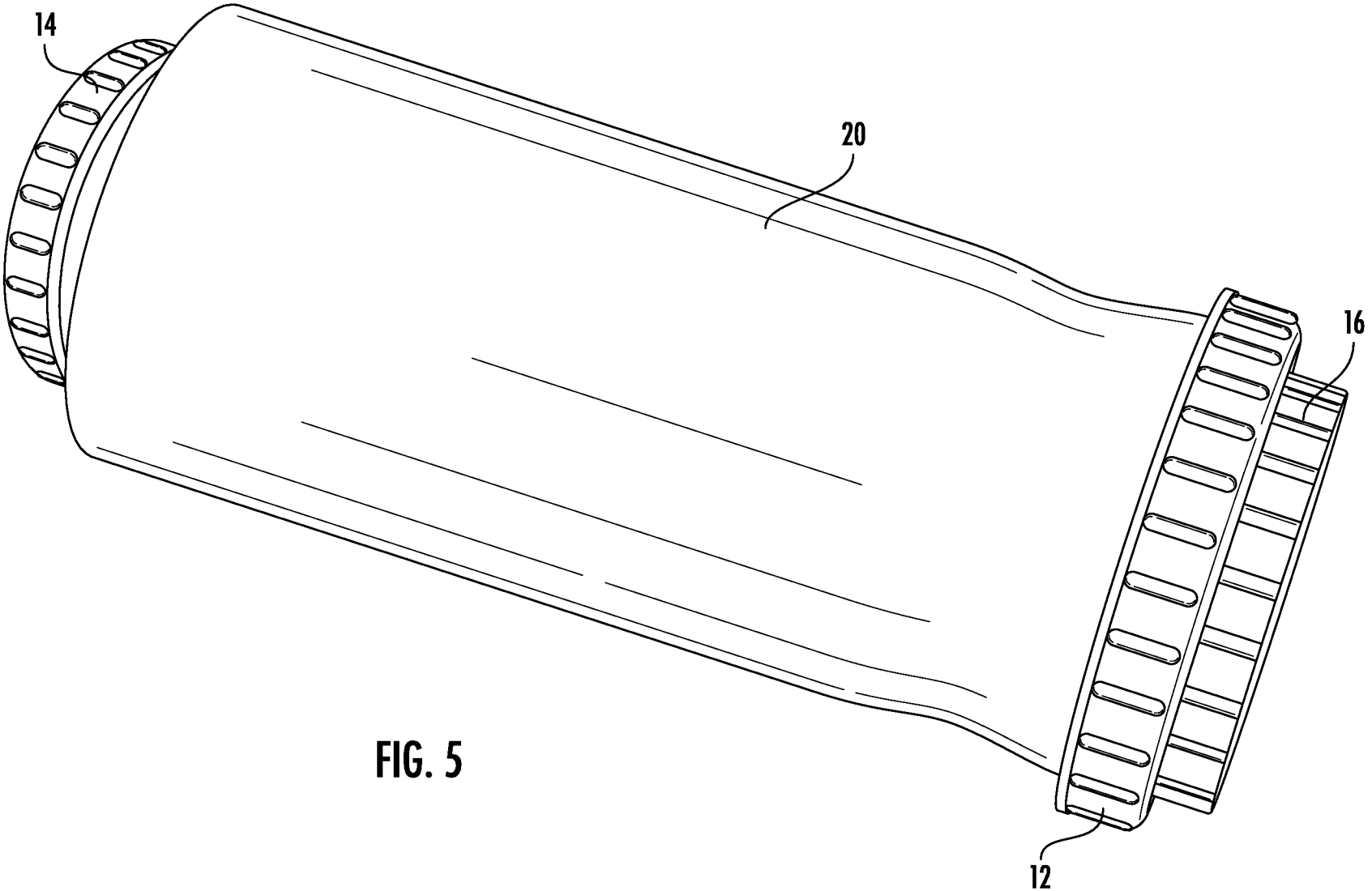
FIG. 5 is a side view of the dispensing device in an embodiment of the invention.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

While the dispenser 10 is generally designed to dispense sauces and semi-solid food products, it may be utilized with any products (edible or inedible, food or non-food) which can be made to flow without great difficulty or which have a putty-like or semi-solid consistency. The dispenser 10 may be particularly well suited for high volume restaurants, such as fast food restaurants. The sauces contemplated herein may include but are not limited to ketchup, mustard, mayonnaise, sour cream, cream cheese, salad dressings, butter, margarine, jellies, soft cheeses, batter, cookie dough, and flavoring sauces.

Speaking generally, the dispensing device of the invention is a hand-held device in which the user can twist a dial in one direction to dispense sauce and twist the dial in the opposite direction to reset the dispensing function. This process can be repeated for multiple applications of sauce, in an assembly line fashion or any other application method. The amount of sauce to be dispensed can be controlled by the user within a range. For example, the user may twist the dial in the first direction and hear one or more audible clicks, each click signaling a particular amount of sauce being dispensed. The dial may then be twisted in the opposite direction to reset the dispensing function. The user may twist the dial in the second direction until another audible click is heard and/or until the dial is prevented from further rotation in the second direction. In an embodiment, for example, the user may twist the dial in a first direction to dispense ⅓ oz. of sauce to a first sandwich (which may comprise 2 clicks, for example), reset the dial by rotating it in a second, opposite direction, and then immediately dispense ⅔ oz. of sauce to a second sandwich (which may comprise 4 clicks, for example). This type of adjustable dispensing would not be possible with conventional dispensing guns. This feature is particularly advantageous in high volume restaurants which allow customers to customize their food, such as a submarine sandwich restaurant.

In an embodiment, the dispenser operates using a ratchet mechanism, rotating in one direction and then locking the ratchet in place until the dial is reset and the ratchet is advanced again. The dial may be limited in the distance it can be twisted in each rotation direction, creating a maximum dispensing quantity per dispensing action.

The ratchet is, in an embodiment, connected to a telescoping mechanism which advances as the ratchet advances and is locked in place when the ratchet is locked in place. The telescoping mechanism may comprise two or more telescoping rods which are nested within one another and can be incrementally expanded lengthwise within the dispenser via the ratchet mechanism.

In an embodiment, the dispensing device utilizes flexible pouches which contain the sauce to be dispensed. The flexible pouch can be inserted into the dispenser before use. As the telescoping mechanism advances, it pushes a plunger downward against the flexible pouch, creating pressure. The flexible pouch reacts to the pressure by dispensing the sauce via a spout or valve near the end of the dispenser, opposite the dial. Once the pressure inside the pouch has been relieved via the dispensing of the sauce, the pouch spout or valve may close and the device can be reset for another dispensing application.

In an embodiment, multiple interchangeable ratchets and dials are provided with the dispensing device. In this embodiment, a first ratchet/dial combination may dispense an amount of sauce within a particular range and a second ratchet/dial combination may dispense a different amount of sauce, optionally within a different range of dispensing amounts. For example, a first ratchet/dial combination may dispense ⅓ oz. to 1 oz. of sauce, while a second ratchet/dial combination may dispense 1 oz. to 3 oz. of sauce. Any number of interchangeable ratchets and dials may be provided. Any volume of dispensing is contemplated.

Device

Referring to the drawings, the dispensing device 10 comprises a dispenser body 20 which may be generally cylindrical in shape. In some embodiments, the dispenser body 20 may have an elliptical, ovular, circular, or oblong cross-section. Any shape known in the art may be utilized for the dispenser body. The dispenser body 20 may have an open top end 48 and a bottom wall 28. The dispenser body bottom wall 28, in some embodiments, has at least one through hole 30 positioned in or near its center. The through hole 30 may be circular, ovular, oblong, elliptical, or may take any other shape known in the art. In an embodiment the through hole 30 may be replaced with a funnel or an inverted funnel, adapted to receive the spout of a flexible plastic pouch.

Figure 19:
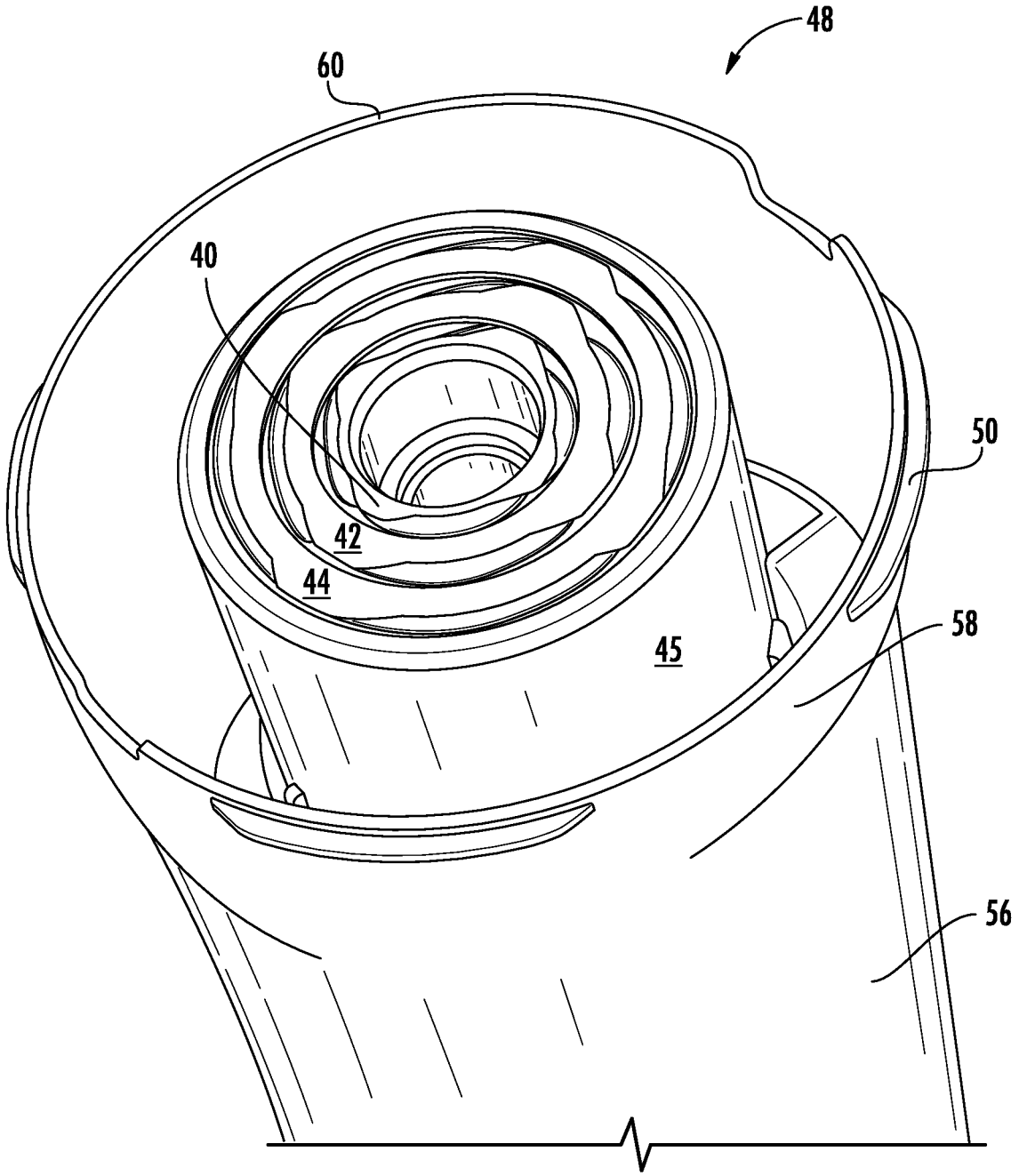
Figure 20:
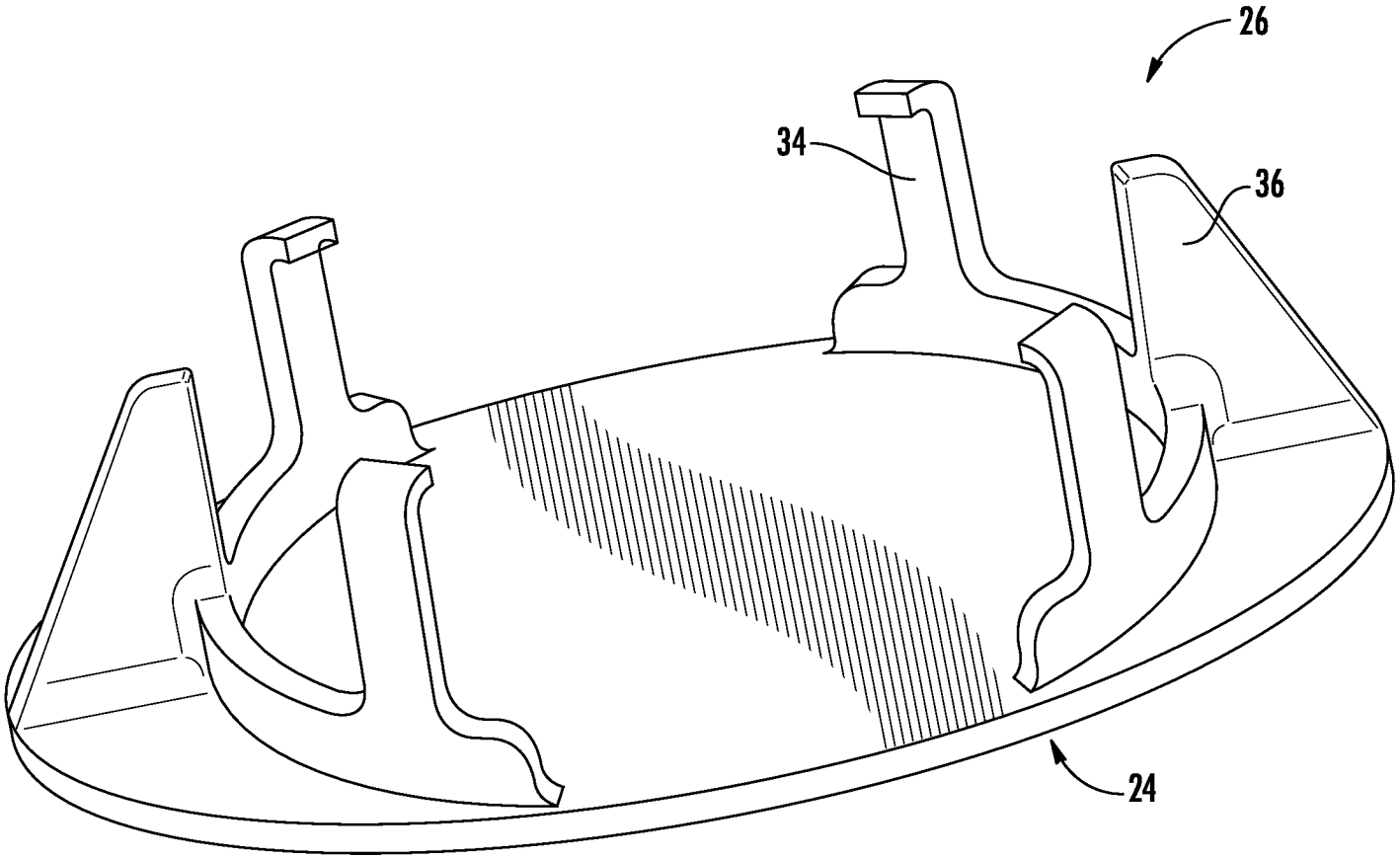

In an embodiment, the dispenser body 20 may have an elliptical cross section through its elongated midsection 55. Near the open top end 48, the elongated midsection 56 may gradually extend outwardly (or inwardly) or angle outwardly (or inwardly) to comprise a shoulder portion 58 having a circular cross section (see FIG. 19). In an embodiment, the largest diameter of the shoulder portion 58 may be the same as or larger than the largest diameter of the elliptical midsection 56. Adjacent the shoulder portion 58, the dispenser body 20 may terminate at the open top end 48 in a rim 60 which has a circular cross-section. In other embodiments, the dispenser body 20 may terminate at the open top end 48 in a flange, collar, or the like.

In an embodiment, the side wall of the dispenser body 20 may have threads 50 disposed on its external surface, near the open top end 48. In an embodiment, the shoulder portion 58 has threads 50 disposed on its external surface, near the open top end 48. The threads 50 may be disposed to receive and engage internal threads 52 disposed on the interior surface of the peripheral rim of a top retaining ring 12. The top ring 12 may contain ribs 54 or other gripping features on its exterior surface, which aid a user in screwing and unscrewing the top ring 12 from the dispenser body 20.

In an embodiment, the top ring 12 is designed to screw onto the rim 60 and close the dispenser body top end 48, retaining one or more dispenser elements within the dispenser body 20. For example, in an embodiment, the dispenser 10 may additionally comprise at least a ratchet support member 38, a ratchet 18, a dial 16, a plunger 26, and one or more telescoping members 40, 42, 44, 45 within the dispenser body. The top ring 12 may be designed to retain one or more of these elements within the dispenser body 20.

As noted, the dispenser 10 comprises one or more telescoping members 40, 42, 44, 45. Generally speaking, the telescoping members 40, 42, 44, 45 are cylindrical or rod-shaped in configuration. The telescoping members 40, 42, 44, 45 are, in an embodiment, varied in diameter and configured such that a first telescoping member fits entirely within a hollow space in the interior of a second telescoping member, and so on. For example, a first telescoping member 40 may have an exterior diameter of X, a second telescoping member 42 may have an interior diameter of approximately X and an exterior diameter of 2×, and a third telescoping member 44 may have an interior diameter of approximately 2× and an exterior diameter of 3×. Likewise, a fourth telescoping member 45 may have an interior diameter of approximately 3× and an exterior diameter of 4×. The actual diameters of the telescoping members 40, 42, 44, 45 may be varied based upon the size and configuration of the dispenser 10 and the needs of the consumer. In an embodiment, a first telescoping member 40 may have an exterior diameter of approximately $1\frac{100}{1000}$ inches, a second telescoping member 42 may have an exterior diameter of approximately $1\frac{500}{1000}$ inches, a third telescoping member 44 may have an exterior diameter of approximately 2 inches, and a fourth telescoping member 45 may have an exterior diameter of approximately 2⅜ inches.

The telescoping members 40, 42, 44, 45 may be threaded on their inner surfaces and/or outer surfaces, such that the interior threads of one telescoping member engages the exterior threads of its adjacent telescoping member. For example, the exterior threads of the first telescoping member 40 may be configured to engage the interior threads of the second telescoping member 42, such that the first telescoping member 40 may fit within the second telescoping member 42. The exterior threads of the second telescoping member 42 may be configured to engage the interior threads of the third telescoping member 44, such that the second telescoping member 42 may fit within the third telescoping member 44. Likewise, the exterior threads of the third telescoping member 44 may be configured to engage the interior threads of the fourth telescoping member 45, such that the third telescoping member 44 may fit within the fourth telescoping member 45. In an embodiment, the fourth telescoping member 45 (or the largest of the telescoping members if there are more or less than four telescoping members) does not have screw threads on its exterior surface.

While four telescoping members are discussed herein, it should be understood that one or more telescoping members are encompassed in the invention. The number of telescoping members, length of each member, and diameter of each member will depend on the size and configuration of the dispenser 10 itself and the needs of the consumer. In an embodiment, the extended length of the combined telescoping members is substantially the same length of the dispenser body 20. In a further embodiment, the extended length of the combined telescoping members is the same length of the dispenser body 20. In yet another embodiment, the extended length of the combined telescoping members is the same as or is substantially the same as the length of the elongated midsection 56.

While the telescoping members herein are discussed as containing threaded screws on their interior and exterior surfaces, any telescoping or nesting mechanism known in the art is contemplated and can be used herein. For example, telescoping pistons, telescoping cylinders, pneumatic telescoping, hydraulic telescoping, single-acting or double-acting telescoping could be utilized herein.

In an embodiment, the telescoping mechanism is positioned axially within the dispenser body 20. A plunger 26 is, in an embodiment, affixed to the end of the largest of the telescoping members, opposite the open end 48 of the dispenser body 20. In an embodiment, the plunger 26 is affixed to the end of the telescoping member which is nearest the dispenser bottom wall 28, such that the plunger 26 is adjacent the dispenser bottom wall 28 when the telescoping members 40, 42, 44, 45 are fully extended. When the telescoping members 40, 42, 44, 45 are fully retracted, the plunger is likewise retracted within the dispenser body 20, to a position nearer the top end 48 and further from the dispenser bottom wall 28.

The plunger 26 may be cylindrical, elliptical, ovular, oblong, or any other shape and its diameter may vary. In an embodiment, the shape of the plunger 26 is substantially the same as or the same as that of the dispenser midsection 56. The size of the plunger 26 may be such that it nests within the interior surface of the dispenser midsection 56. The plunger 26 should be axially movable or slidable within the dispenser body 20, toward and away from the dispenser bottom wall 28. In an embodiment, the smallest diameter of the plunger 26 is the same as or larger than the diameter of the telescoping member to which it is attached. In an embodiment, the shorter diameter of the elliptical plunger 26 may be between about 2 and 3 inches and, in an embodiment, may be about 2⅝ inches. In an embodiment, the longer diameter of the elliptical plunger 26 may be between about 3 and 4 inches and, in an embodiment, may be about 3¾ inches. The plunger 26 is configured to be advanced within the dispenser body 20 toward the dispenser bottom wall 28.

Figure 6A:
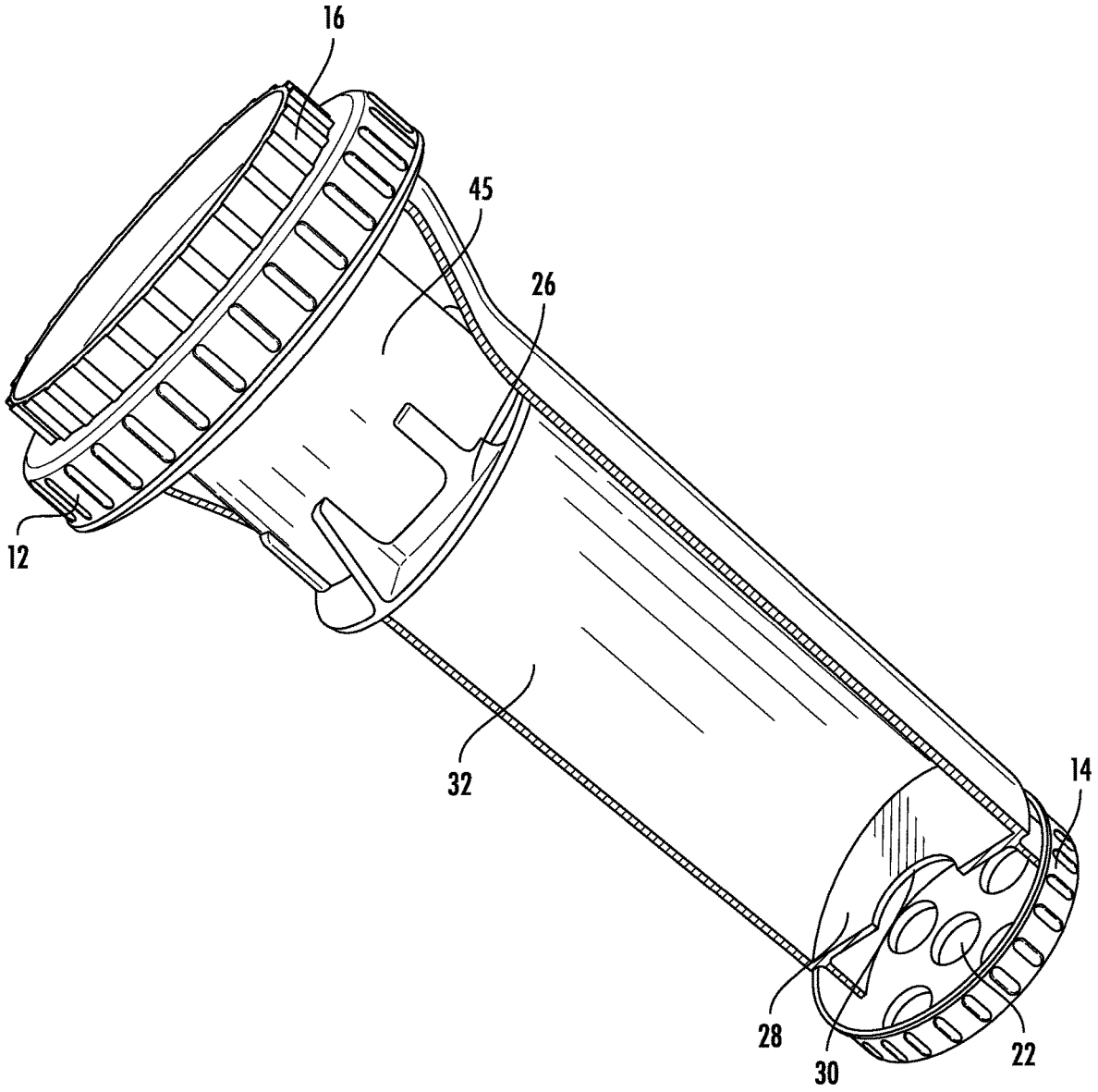
FIGS. 6A-6C are partial cutaway perspective views of the dispensing device in an embodiment of the invention, illustrating the plunger in a retracted position.
Figure 6B:
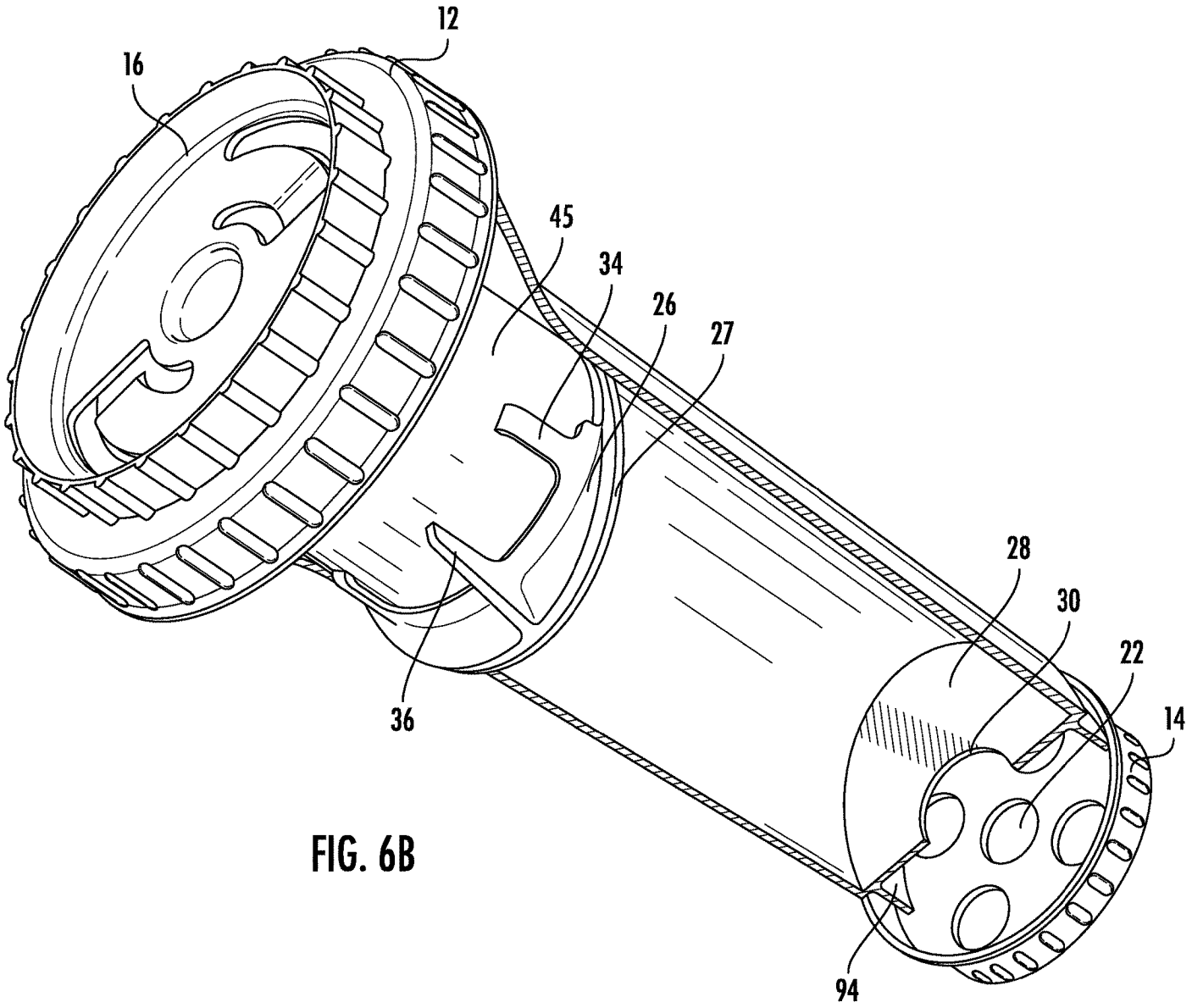
Figure 6C:
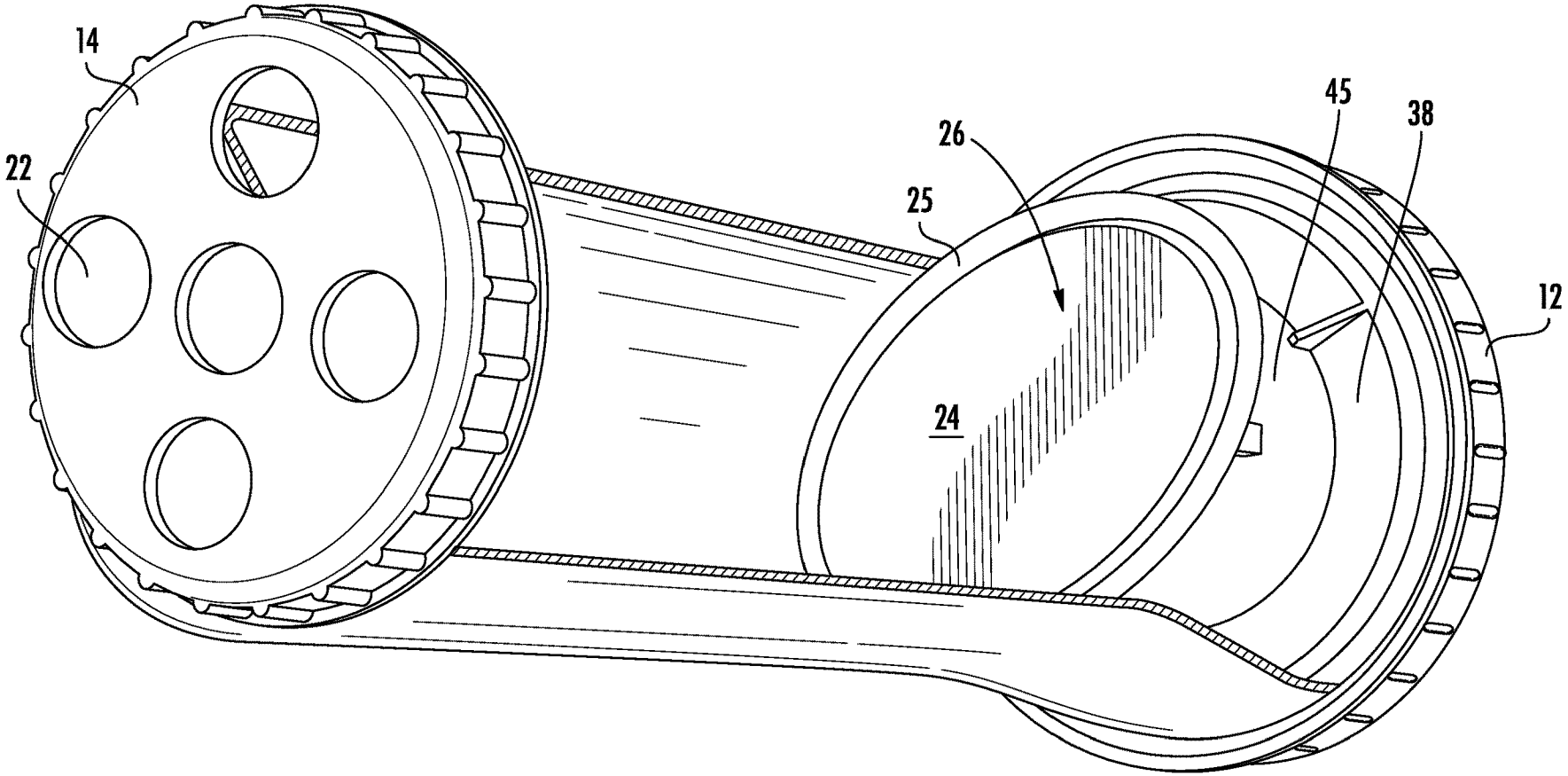
Figure 7A:
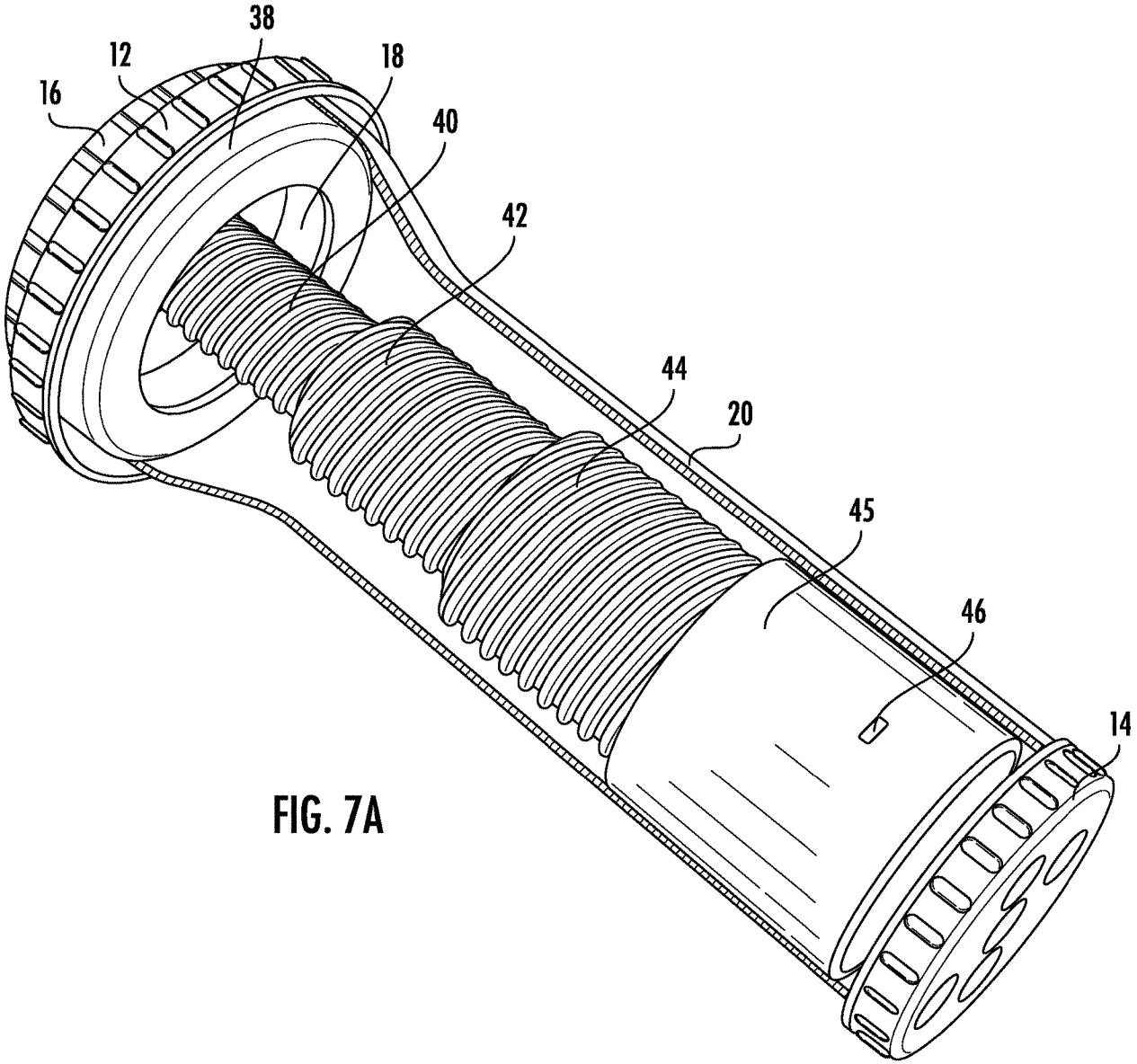
FIGS. 7A-7B are partial cutaway perspective views of the dispensing device in an embodiment of the invention, illustrating the plunger in an extended position.
Figure 7B:
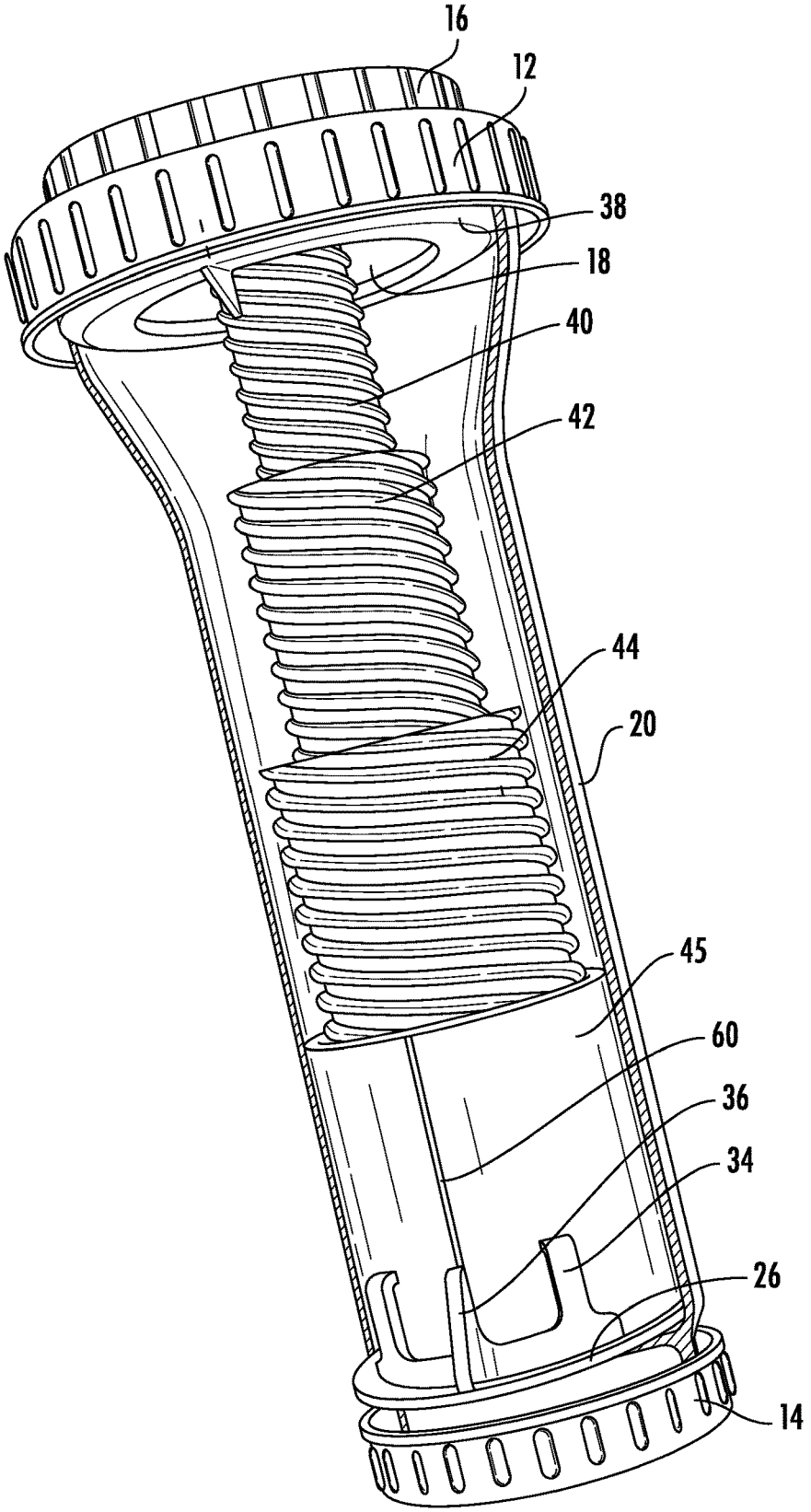
Figure 8A:
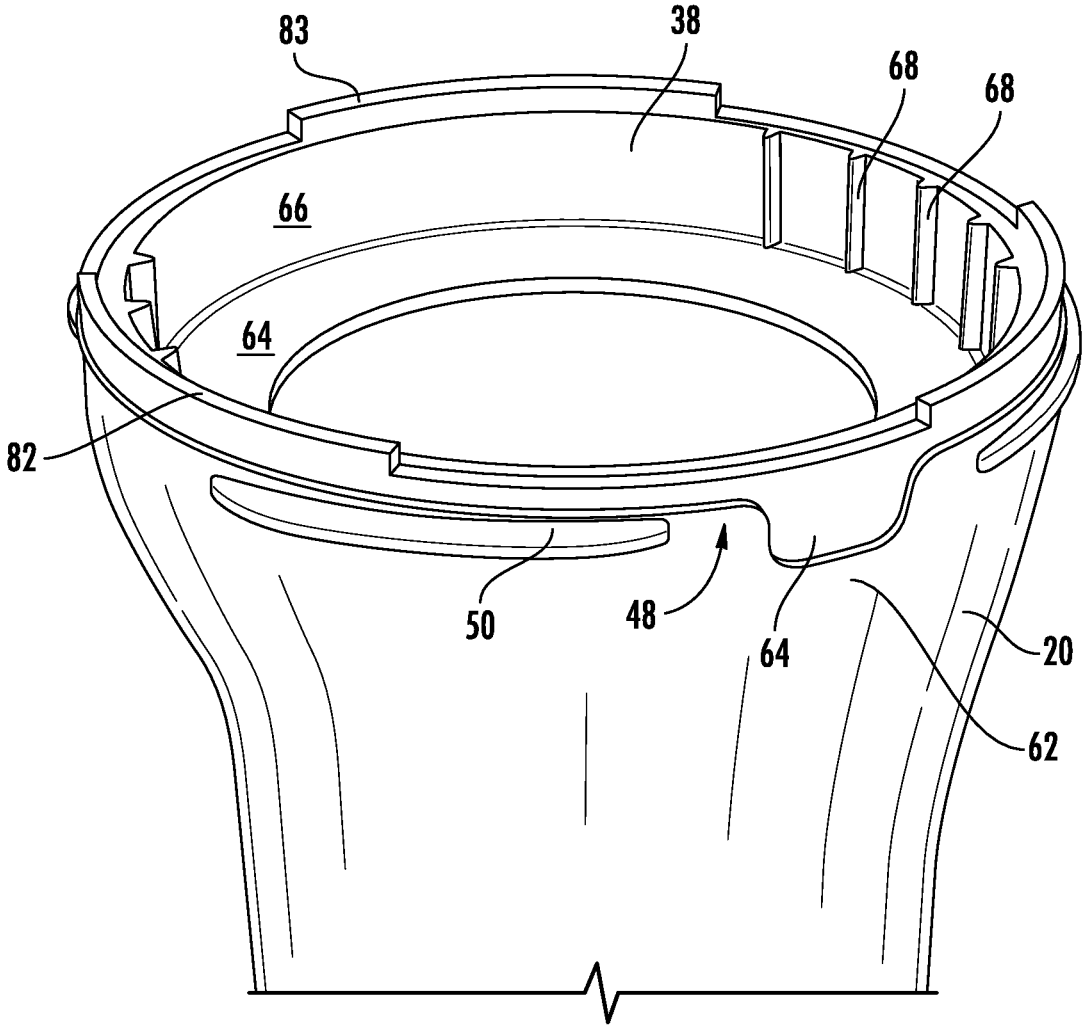
FIGS. 8A-8B are perspective views of the ratchet support aspect of the dispensing device in an embodiment of the invention.
Figure 8B:
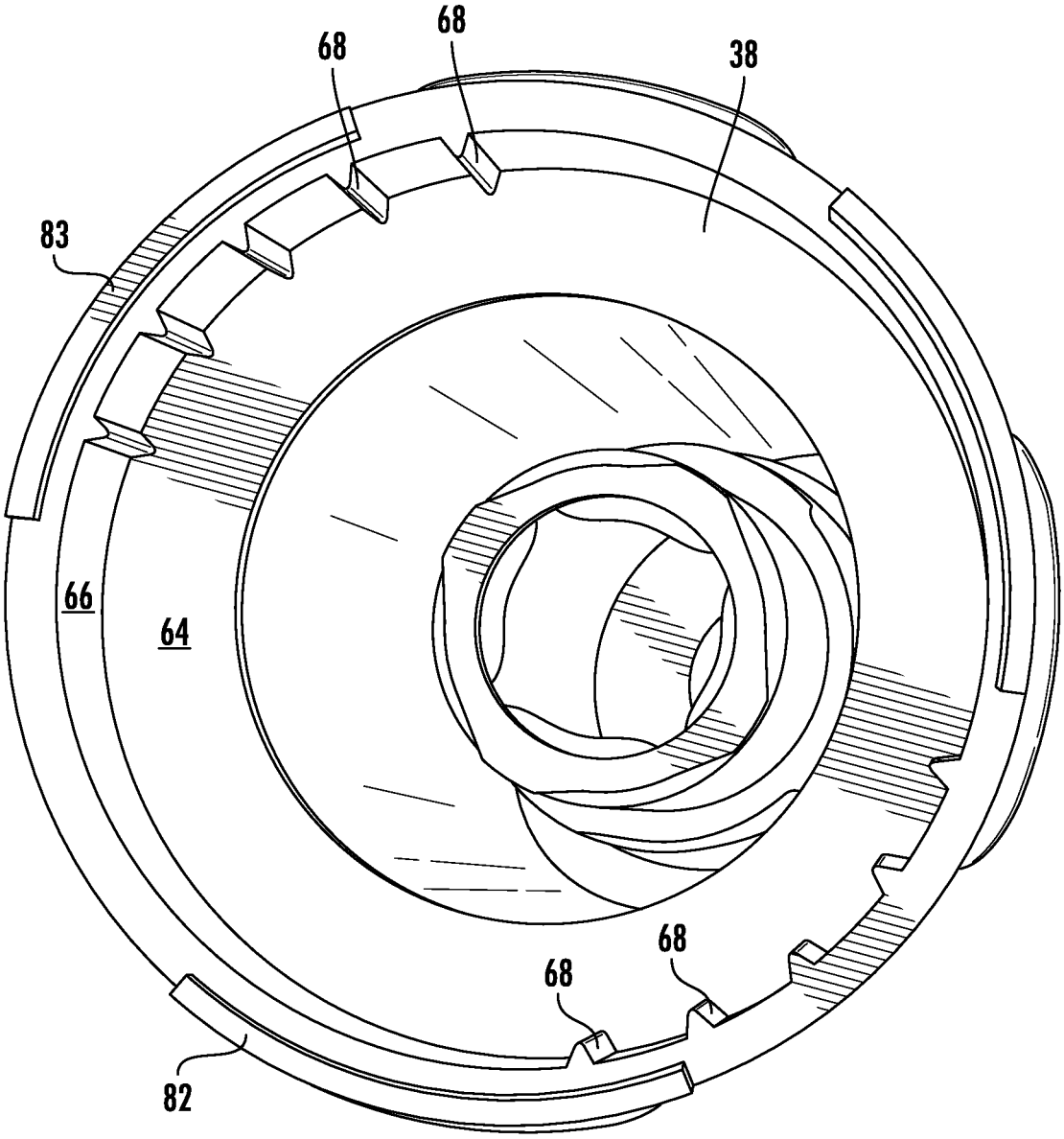
Figure 9:
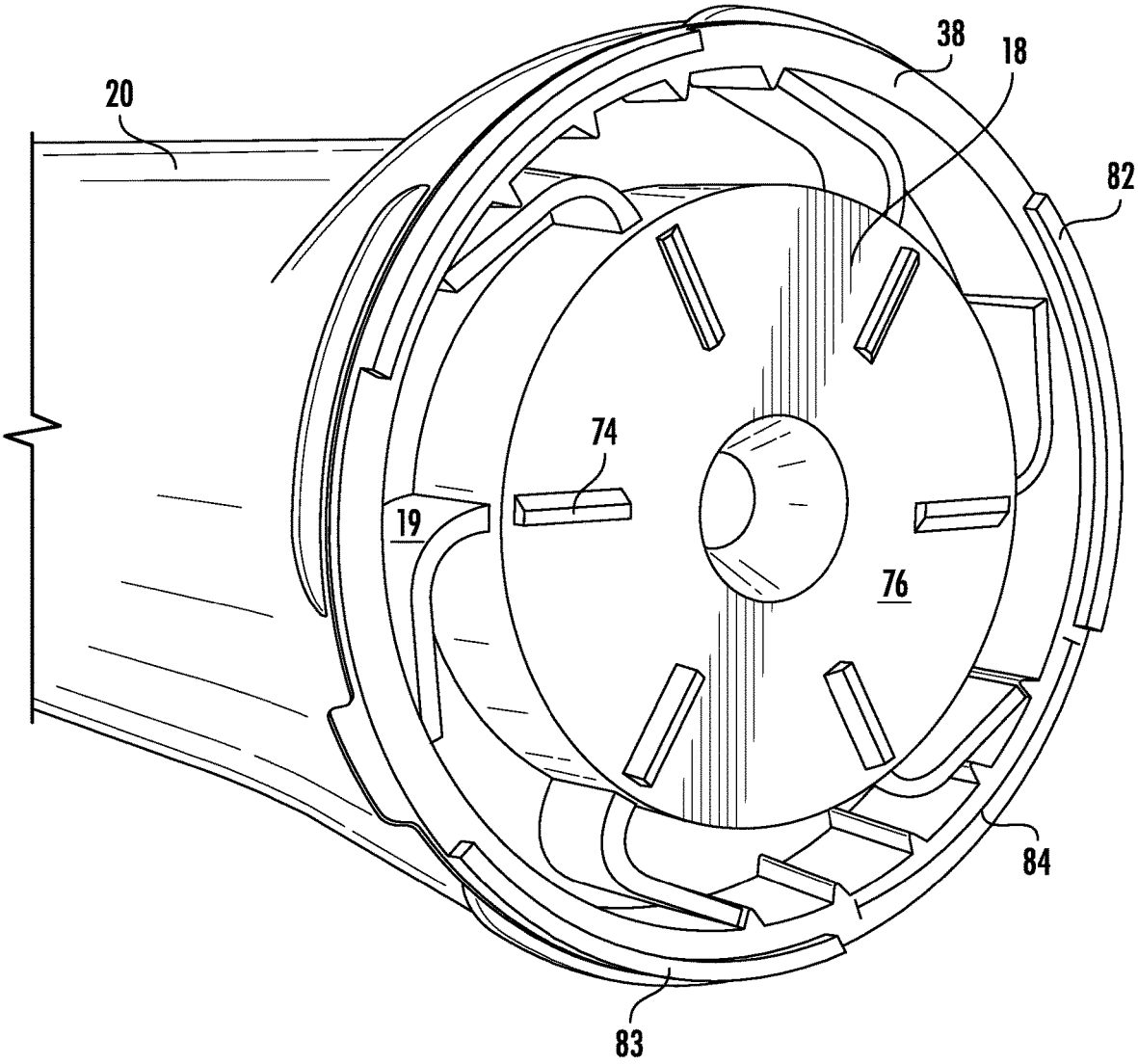
FIG. 9 is a perspective view of the ratchet aspect of the dispensing device in an embodiment of the invention.
Figure 10:
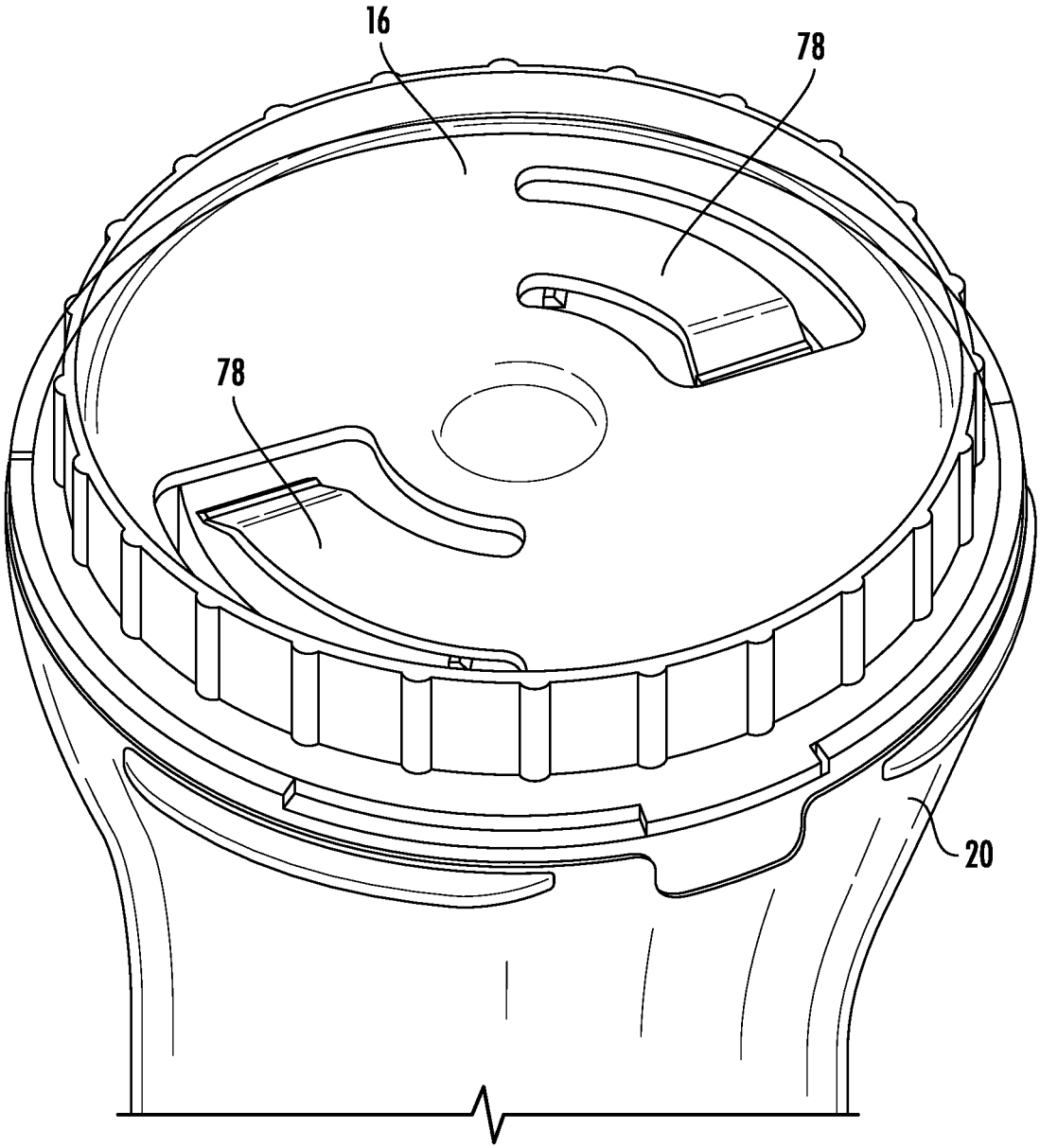
FIG. 10 is a perspective view of the dial aspect of the dispensing device in an embodiment of the invention.
Figure 11:
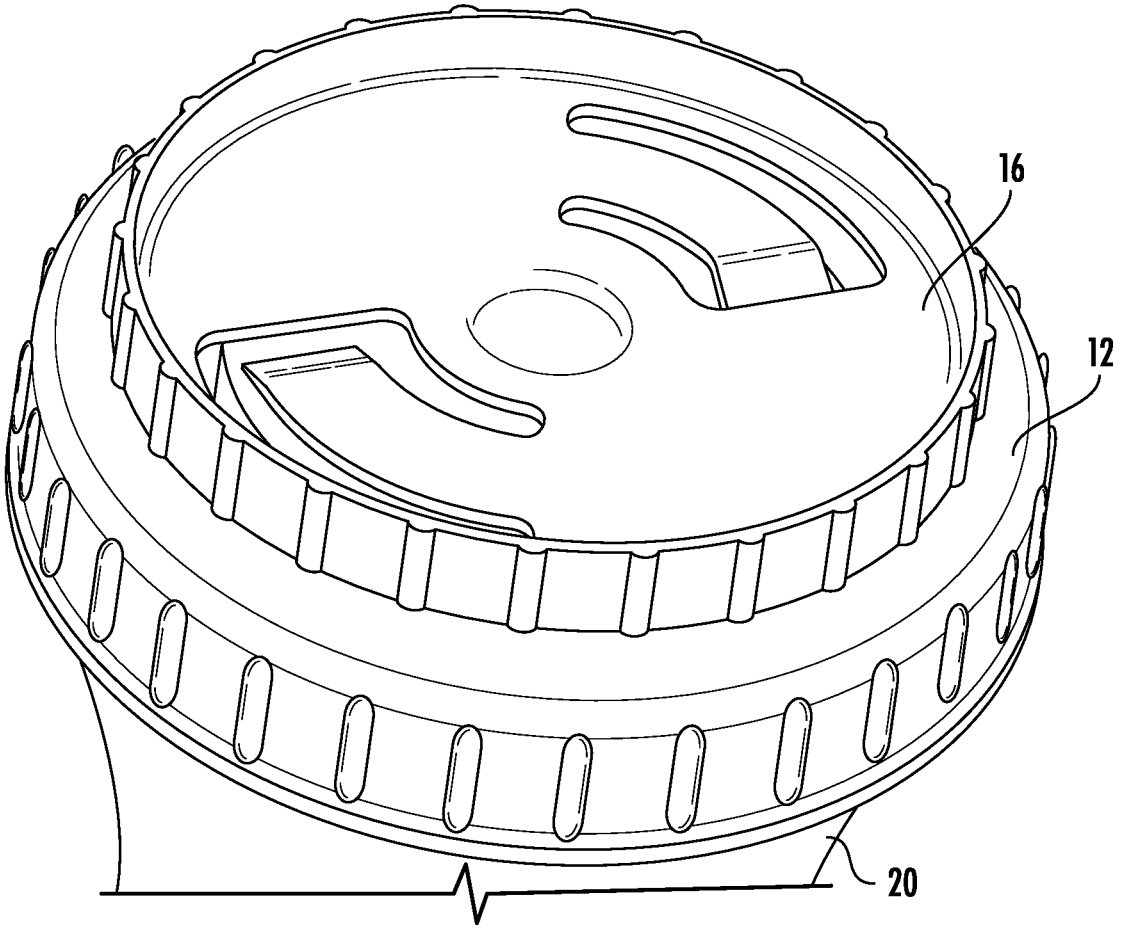
FIG. 11 is a perspective view of the top ring aspect of the dispensing device in an embodiment of the invention.
Figure 12:
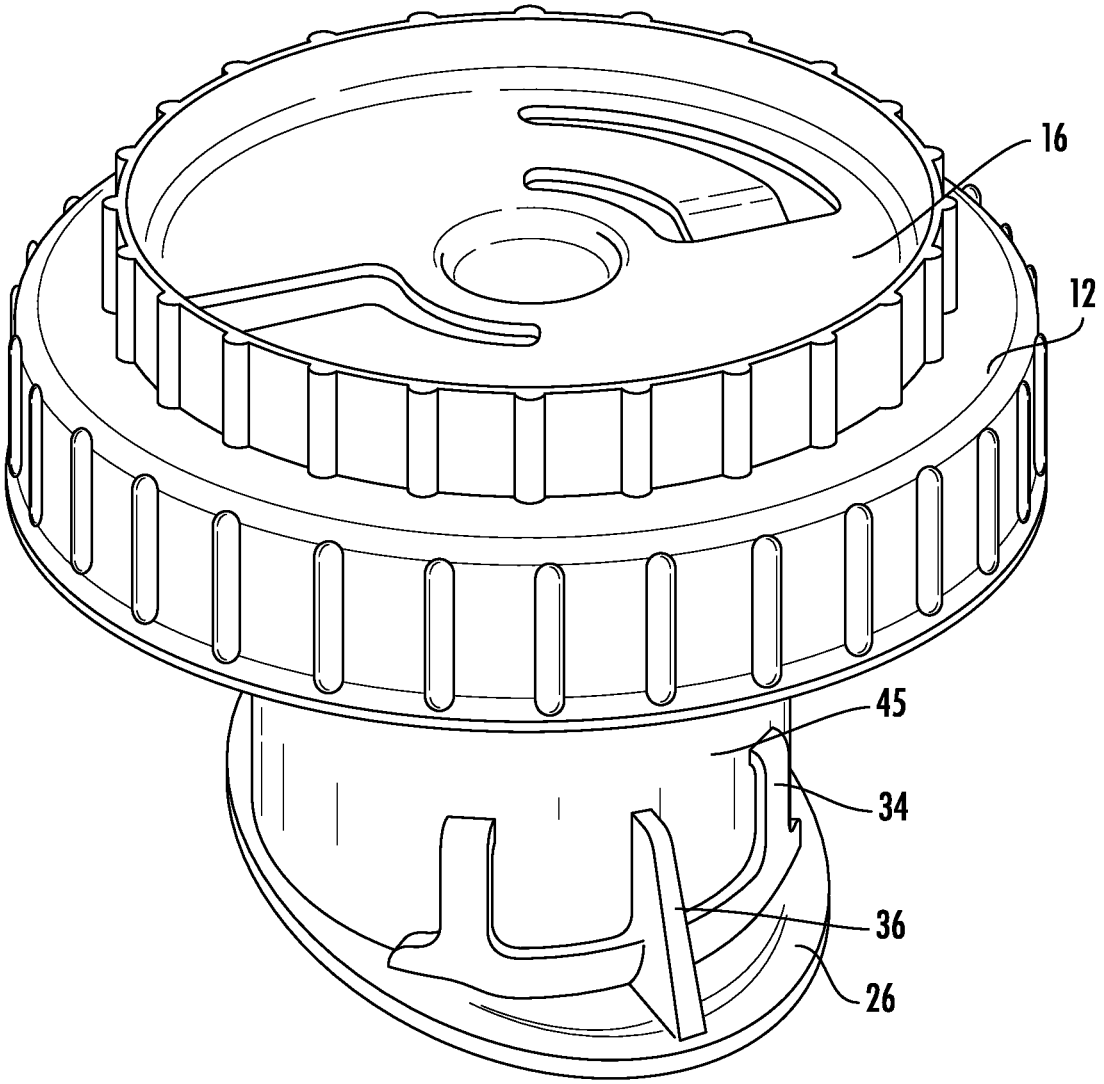
FIGS. 12-15 are perspective views of the plunger subassembly aspects of the dispensing device in an embodiment of the invention, in retracted and extended positions.
Figure 13:
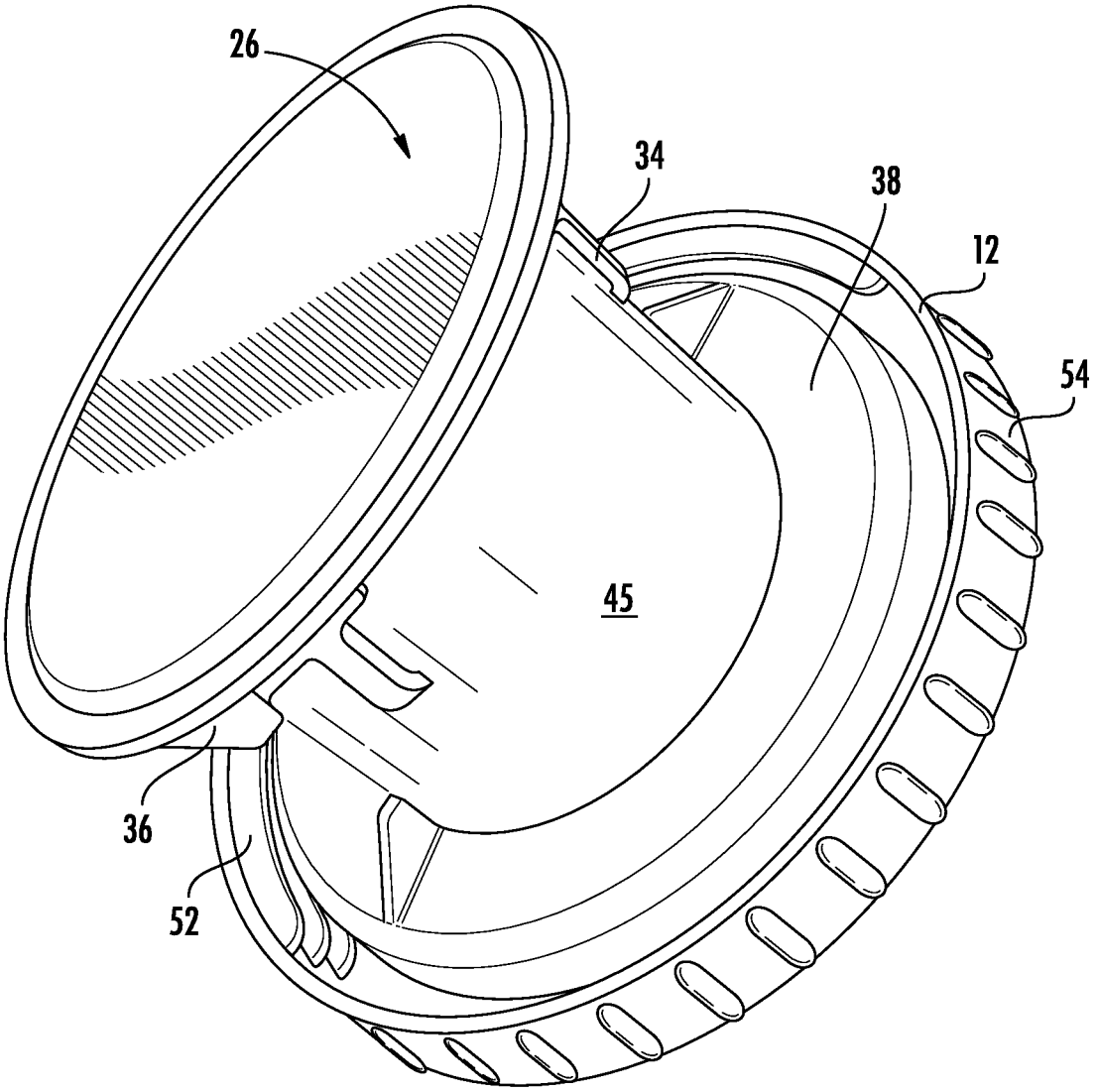
Figure 14:
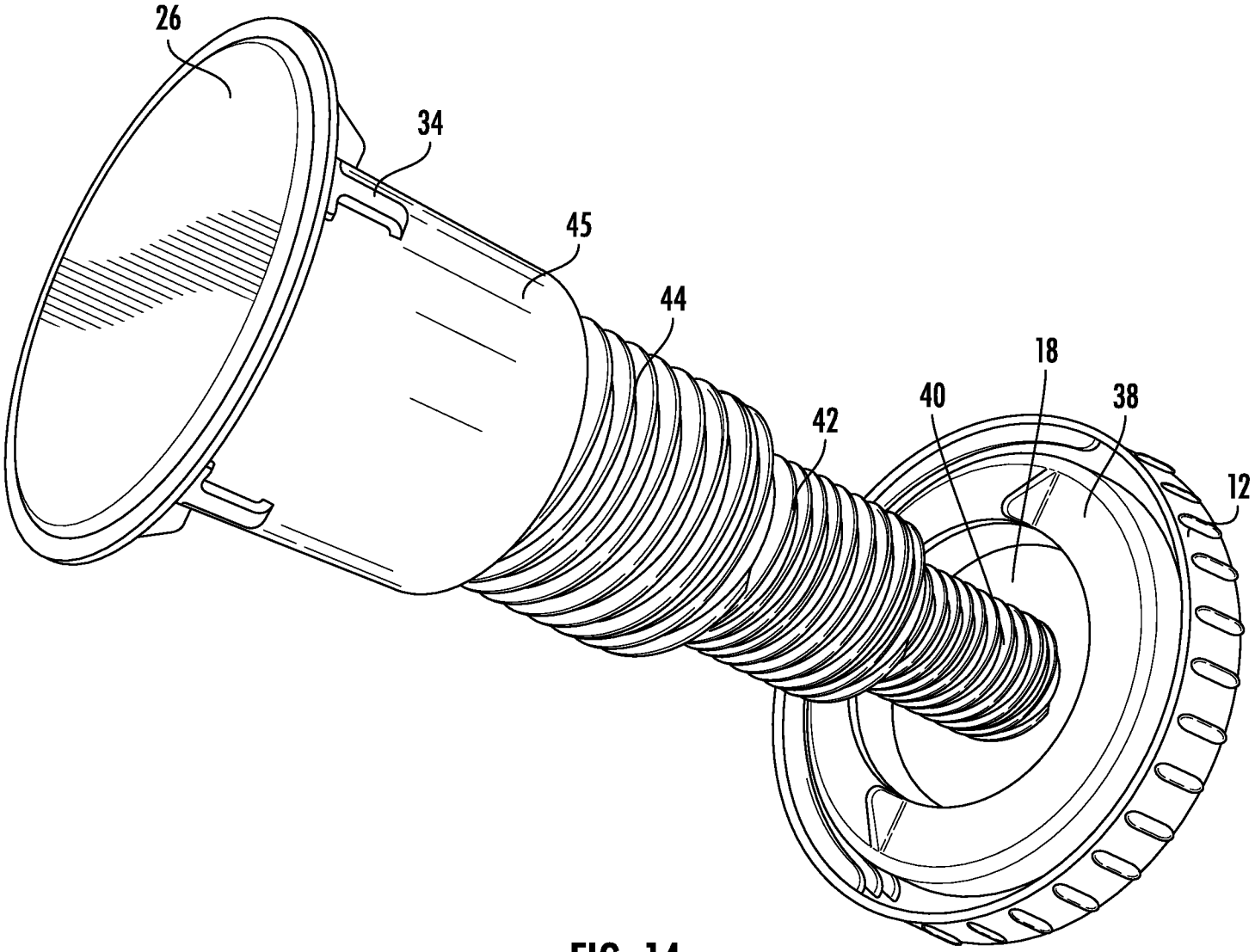
Figure 15:
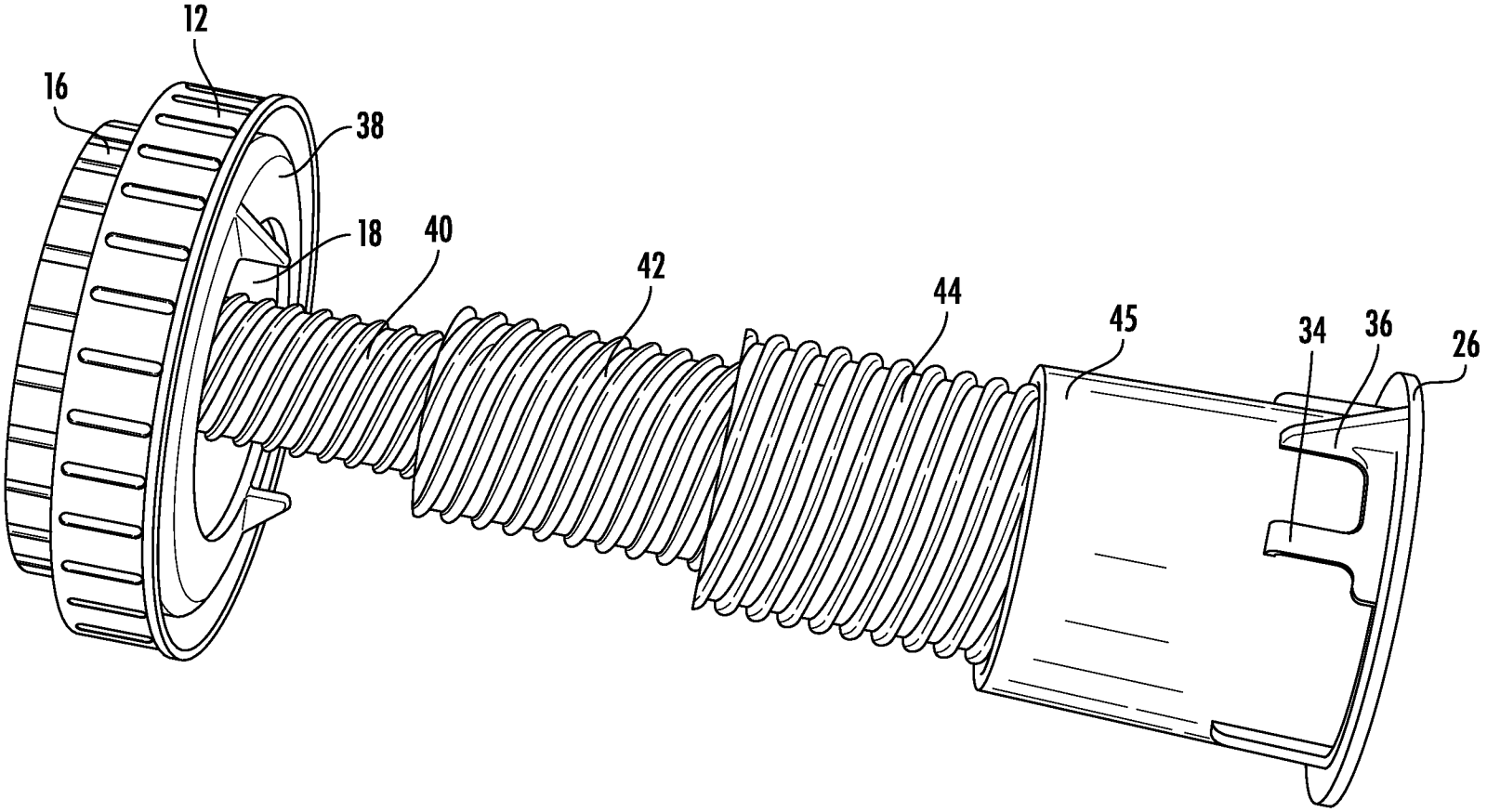

In an embodiment, the plunger 26 may comprise a generally flat face 24 which is positioned substantially perpendicular to or perpendicular to the dispenser sidewalls and/or the dispenser body 20 axis. The face 24 of the plunger 26 may terminate in a flange or collar 25 which extends around its circumference, in an embodiment. The collar 25 may be angled slightly inwardly or outwardly from the generally perpendicular plunger face 24. In an embodiment, the face 24 and/or the collar 25 may additionally comprise a lip or rim 27 (shown in FIG. 6B) which may be useful in wiping the interior sides of the dispenser body 20 as the plunger 26 is advanced downwardly. The lip or rim 27 may be disposed at an angle, may be substantially parallel to or parallel, or may be substantially perpendicular to or perpendicular to the dispenser body 20 axis. In an embodiment, the lip or rim 27 may be made from a flexible material, such as a flexible plastic, silicone, or rubberized material, which does not interfere with the movement of the plunger 26, but flexes to wipe the interior of the dispenser as the plunger 26 advances.

The plunger 26 may be affixed to the telescoping member 45 using any means known in the art. The plunger 26 may, for example, be adhered, screwed, friction fitted, threaded, soldered, or otherwise joined to the telescoping member 45 using any method known in the art. In an embodiment, the plunger 26 may be a unitary part of the telescoping member.

In a particular embodiment, the plunger 26 may comprise one or more tabs 34 which interlock into a matching hole 46 or depression in the telescoping member 45 to which it is affixed. In an embodiment, the locking tabs 34 are elongated perpendicularly from the face 24 of the plunger 26. In an embodiment, multiple locking tabs 34 are utilized to affix the plunger 26 to the telescoping member 45. In a particular embodiment, four locking tabs 34 are positioned about the circumference of the telescoping member 45 and each interlocks with a matching hole 46 or depression in the sidewall of the telescoping member 45. In an embodiment, the plunger 26 is locked in place upon the end of the telescoping member 45 using the tabs 34 and holes 46.

In an embodiment, the plunger 26 additionally comprises one or more braces 36. The braces may be configured in any manner known in the art to support the plunger face 24 as downward pressure is exerted on the plunger 26. In an embodiment, the braces are provided in a generally triangular shape between the rim or edge of the plunger face 24, the intersection of the plunger face 24 and the telescoping member 45, and upwardly against the exterior wall of the telescoping member 45. In an embodiment wherein the dispenser midsection 56 and the plunger 26 are each elliptical and the telescoping member 45 is cylindrical, a plunger brace 36 may be positioned at the largest diameter of the plunger 26 ellipse, on each side of the telescoping member 45. In an embodiment, the telescoping member 45 may contain a seam or depression 60 which aligns with the edge of the brace 36 adjacent the telescoping member 45 or aligns with a rib on the edge of the brace 36 adjacent the telescoping member 45.

In an embodiment, the telescoping members have a gravity telescoping action. In an embodiment, when the telescoping members are not retained within the dispenser body 20 with the plunger 26 attached thereto, the telescoping members are configured to move in and out of a telescoping relationship based upon gravitational forces, without any manually-applied twisting, turning, rotating or screwing. Said in another way, if one were to hold the largest of the telescoping members with the smaller members retained inside of it and then invert the largest telescoping member, flipping the telescoping mechanism upside down, each of the smaller telescoping members engaged within the largest telescoping member would slide down the screw threads and the telescoping mechanism would expand to its greatest length, due only or primarily to gravitational forces. Likewise, if one were to then flip the telescoping mechanism back over again, each of the telescoping members would again slide down the screw threads, each telescoping member retracting into another telescoping member, and the telescoping mechanism would retract to its shortest length.

In an embodiment, the telescoping member threads may be treated with a lubricant to aid this function and effect.

In an embodiment, the dispenser body 20 elongated midsection 56 is elliptical in cross section, the two or more telescoping members 40, 42, 44, 45 are cylindrical, and the plunger 26 is elliptical. In this configuration, the matching elliptical shape of both the elongated midsection 56 and the plunger 26 prevents the telescoping members from extending and retracting in this manner (gravitationally) while inside the container body 20, without an external manual force exerted upon the device. Without the presence of the elliptical plunger 26, in this embodiment, the telescoping members would retract and expand gravitationally within the dispenser body 20, independent of such external, manually-applied forces.

Figure 16:
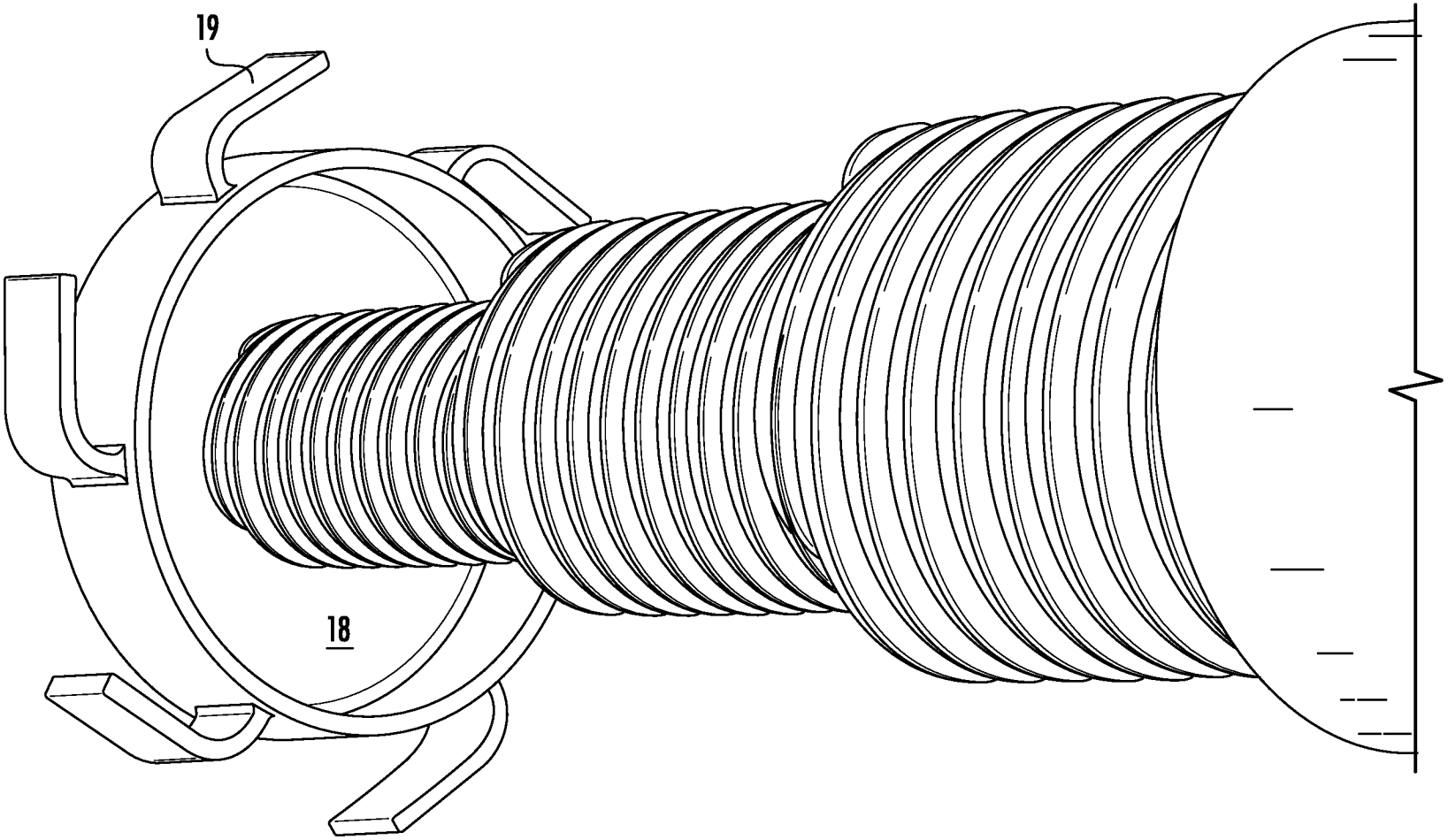
FIGS. 16-26 are component views of various subassemblies of the dispensing device, in an embodiment of the invention.
Figure 17:
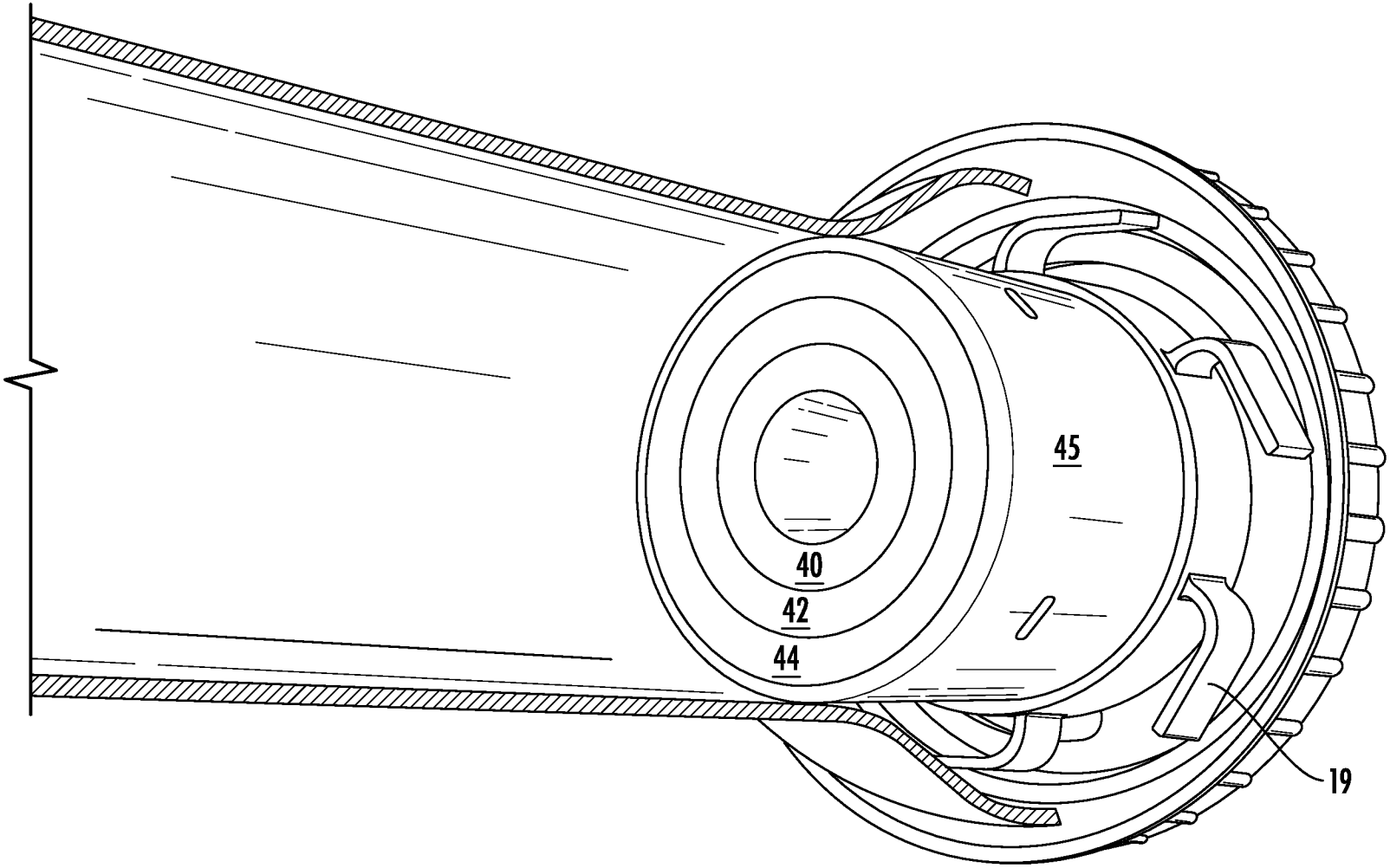
Figure 18A:
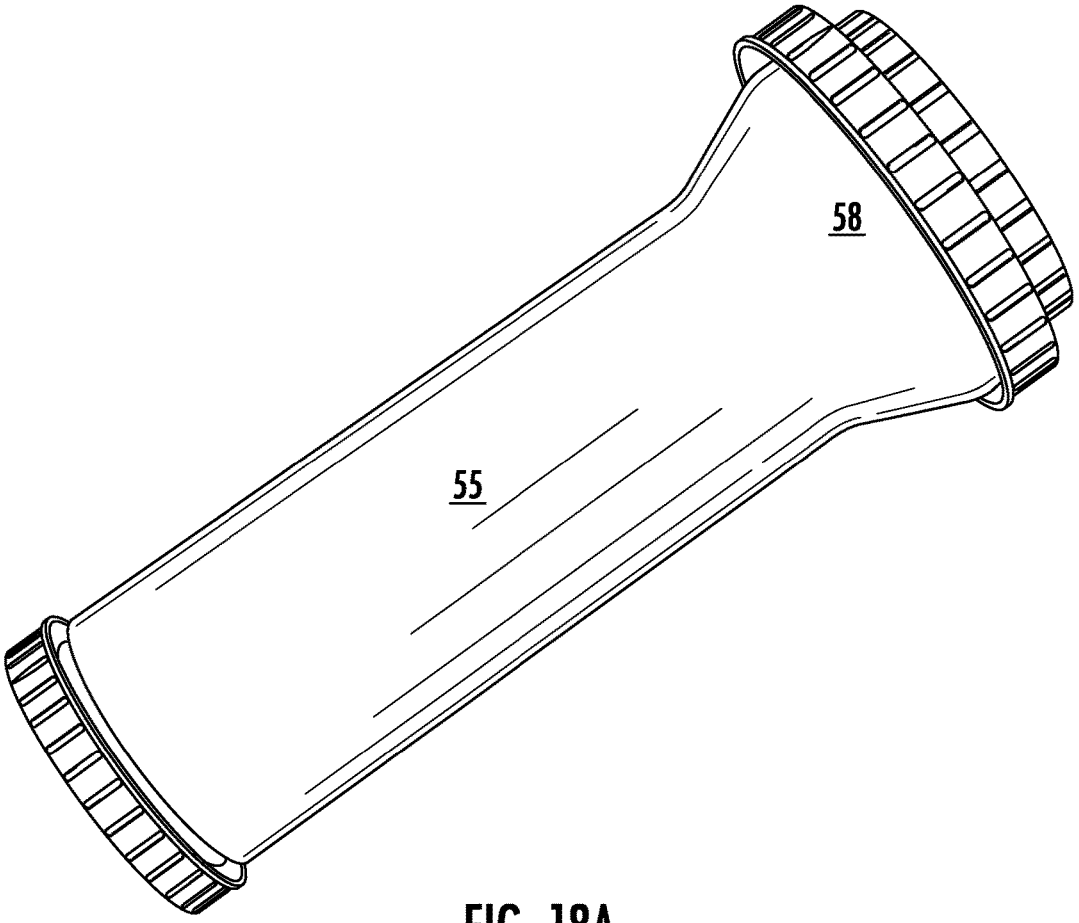
Figure 18B:
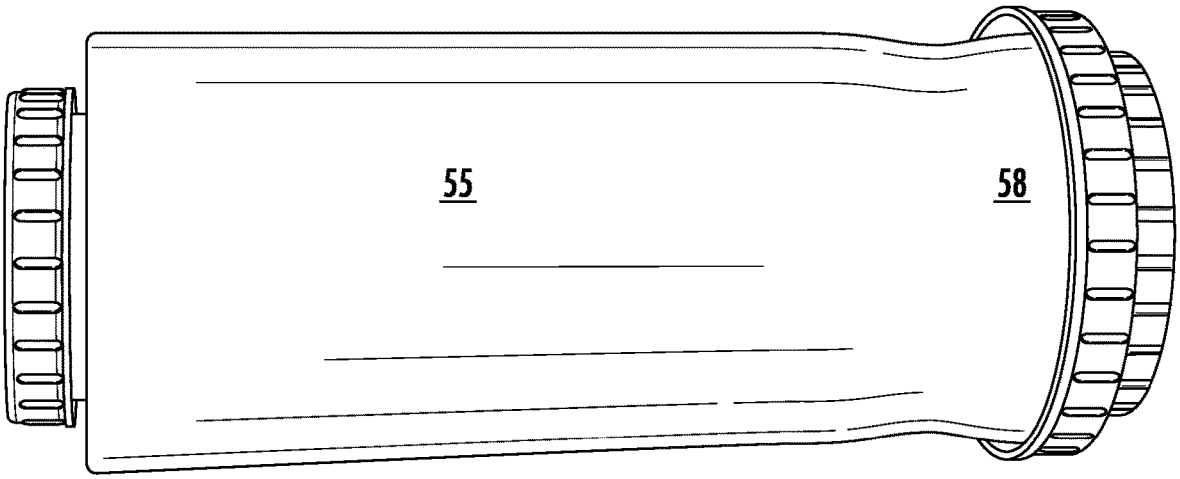
Figure 21:
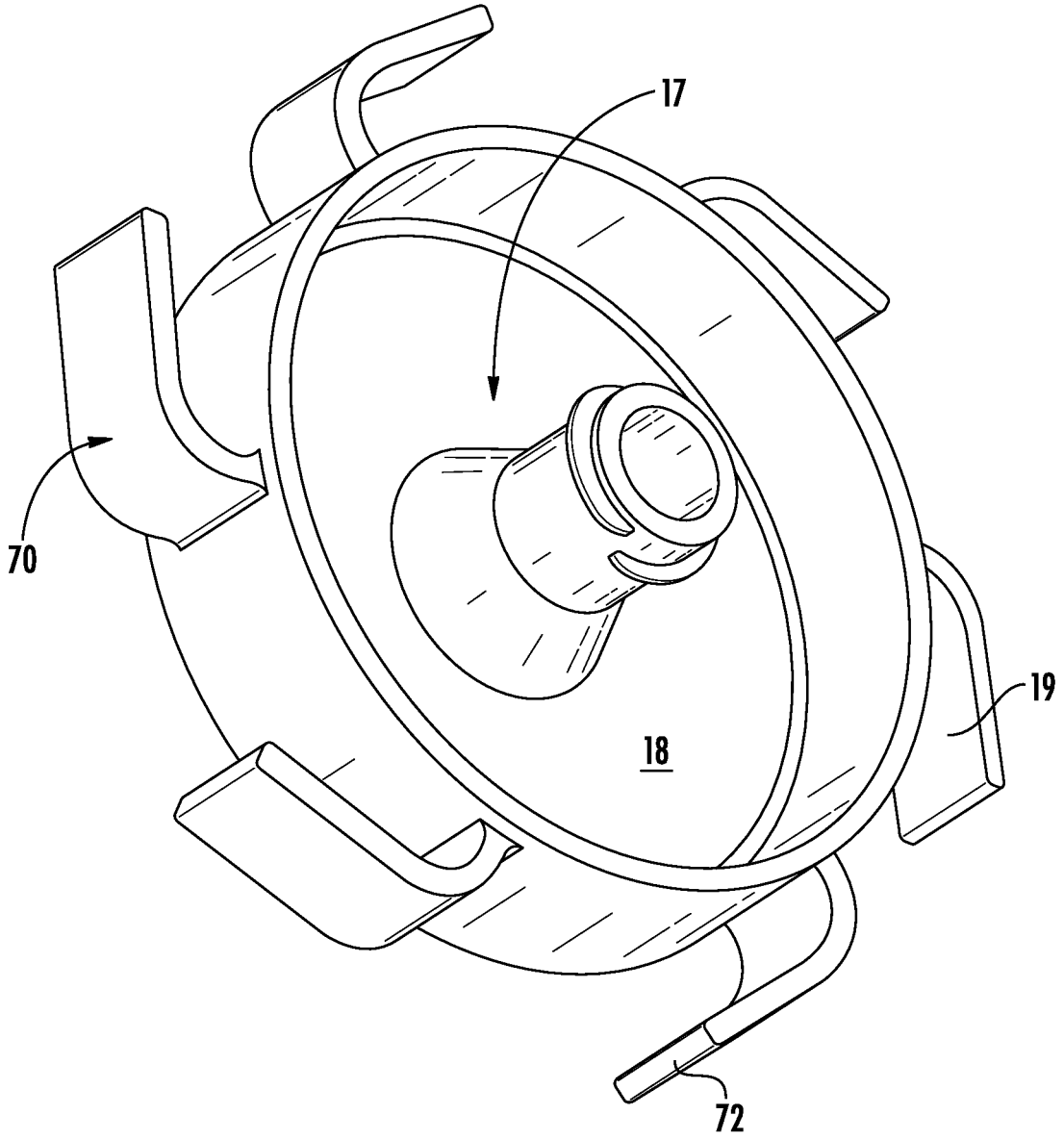
Figure 22:
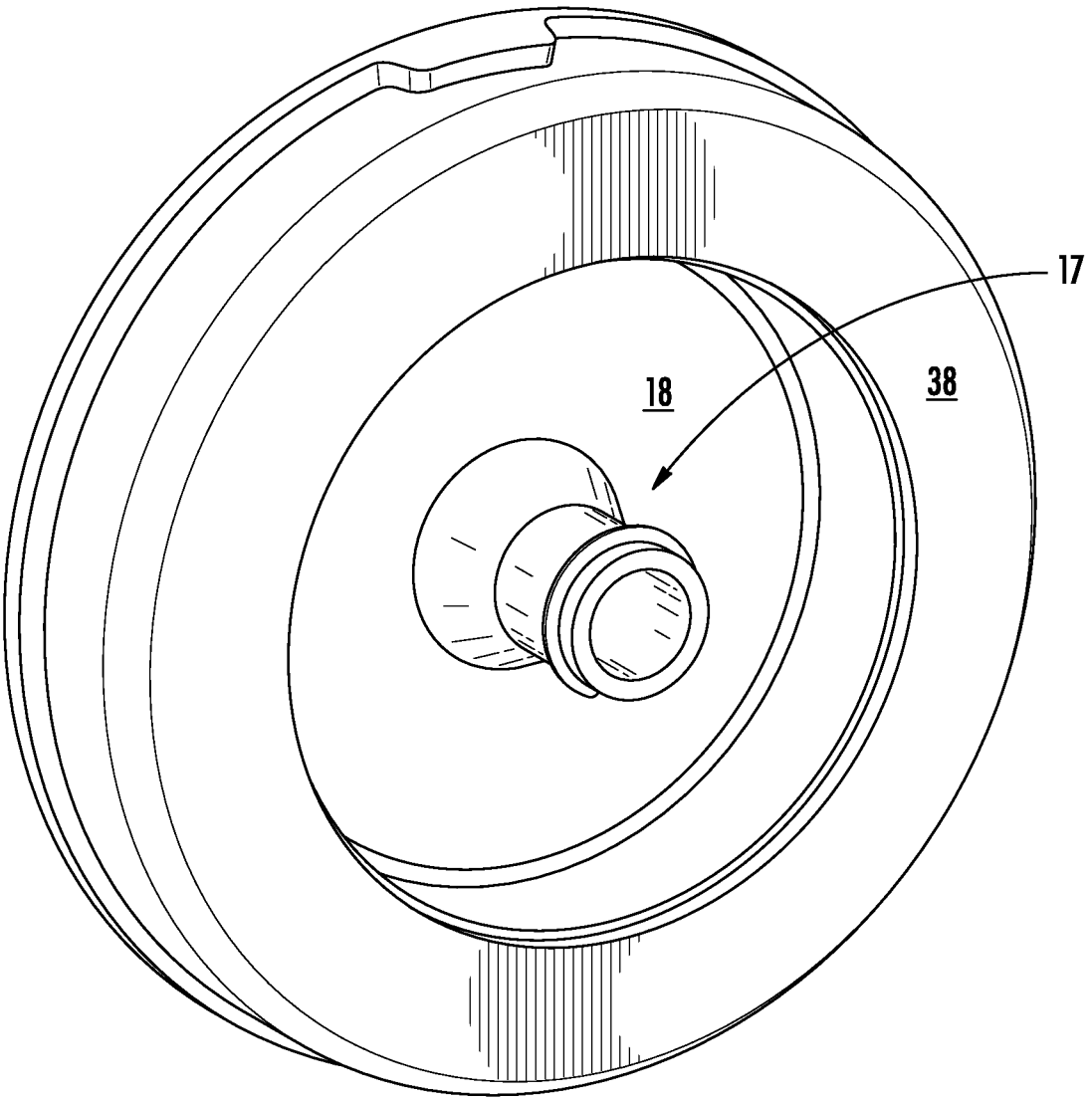
Figure 23:
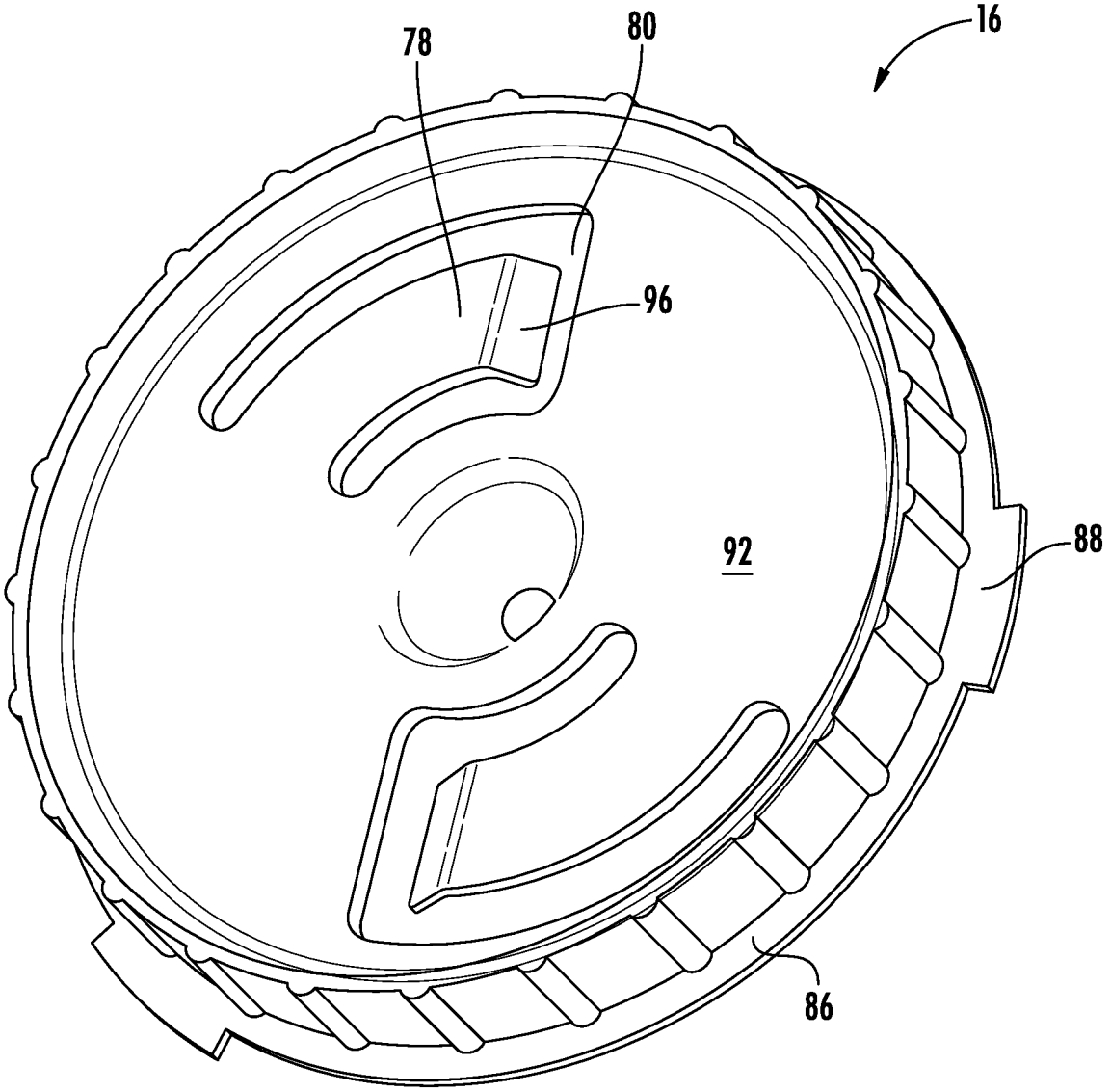
Figure 24:
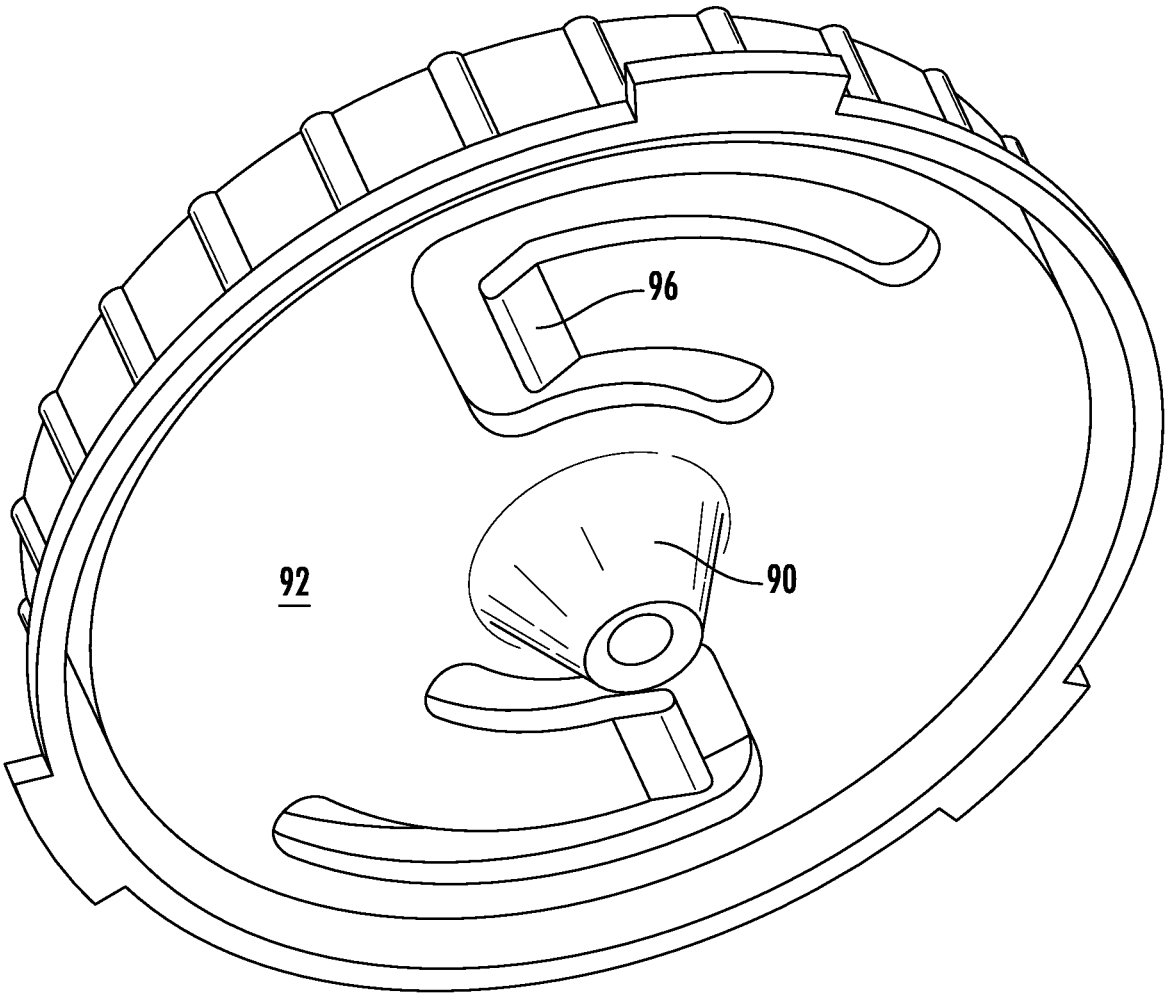
Figure 25:
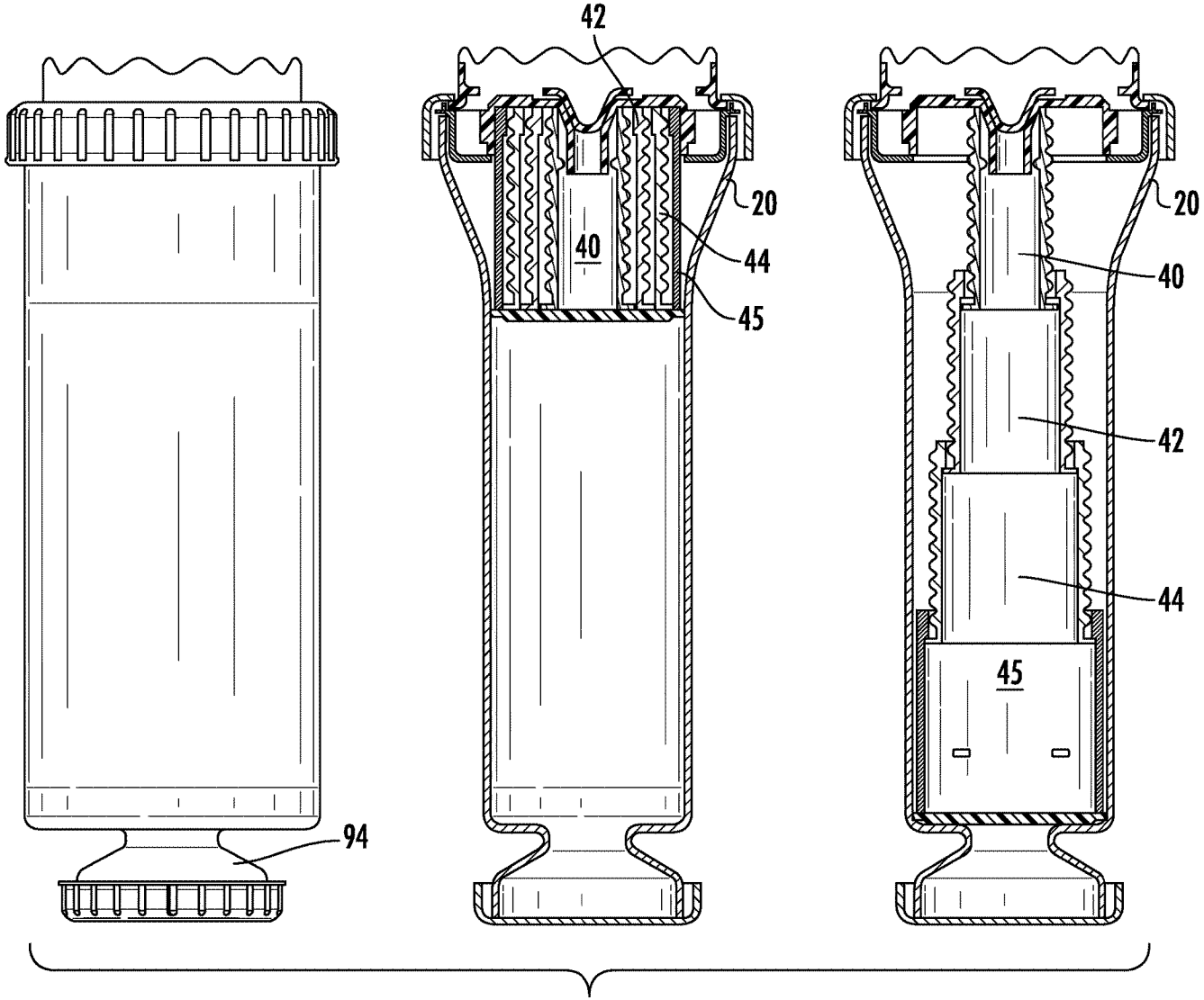
Figure 26:
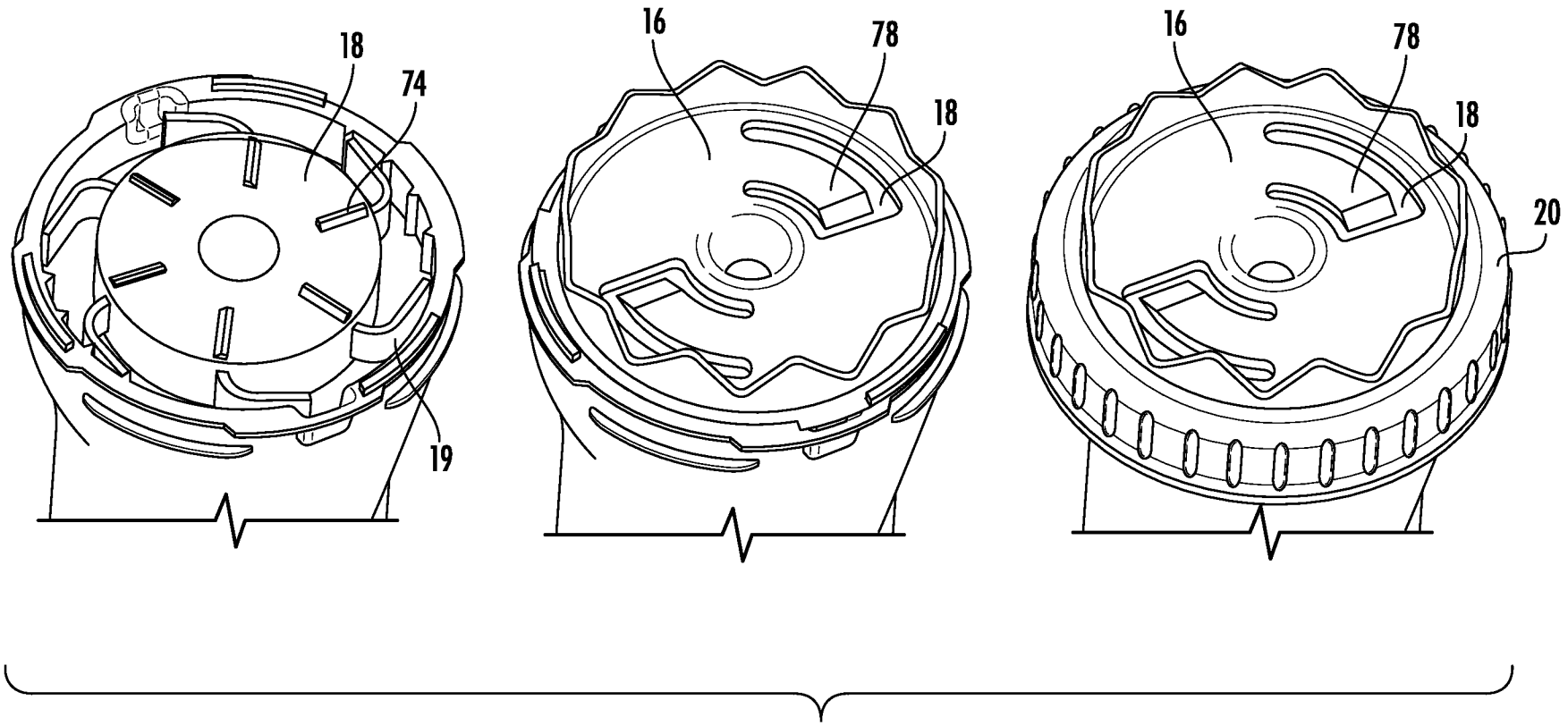

On the end of the telescoping members opposite the plunger 26, the end of the telescoping member 40 having the smallest diameter may be affixed to a ratchet 18 (FIG. 16). The ratchet 18 may comprise any shape, but in an embodiment, the ratchet 18 is generally wheel-shaped or circular and is affixed to the telescoping member 40 in a generally perpendicular manner. In an embodiment, the ratchet 18 may have a through hole in its center. The ratchet 18 may have a perpendicularly extending connection means 17 which enables the telescoping member 40 to be affixed to the ratchet 18 (FIG. 21). In this embodiment, the connection means 17 may comprise a cylindrical post or shaft which has threads about its exterior surface. The threads on the exterior surface of the connection mean 17 may be configured to engage with internal threads on the telescoping member 40. In this manner, the telescoping member 40 can be screwed onto and permanently affixed to the ratchet 18.

The ratchet 18 may have one or more teeth 19 arranged about its circumference. The ratchet teeth 19 may be of any shape known in the art which can be configured to engage with a pawl, cog, or tooth. In an embodiment, the wheel ratchet 18 is configured to be turned in a clockwise or counter-clockwise motion. In an embodiment, the arrangement of the teeth 19 allows rotary motion in only one direction, preventing or substantially preventing motion in the opposite direction. In an embodiment, the arrangement of the teeth 19 allows rotary motion in a first direction, but prevents motion in a second, opposite direction past a certain point. When the ratchet 18 is moving in the unrestricted direction, the teeth 19 may be configured to slide up and over an opposing pawl, cog, or tooth. When this occurs, an audible click may be heard. When the ratchet 18 is moved in the restricted direction, however, the teeth 19 may catch against an opposing pawl, cog, or tooth, preventing further motion in the restricted direction. In an embodiment, the ratchet teeth 19 have a certain amount of flexion, such that they can move up and over an opposing pawl, cog, or tooth in the unrestricted direction and move back into a neutral position after passing over the pawl, cog, or tooth.

In an embodiment, the ratchet teeth 19 may be elongated and may curve or be angled an equal amount and distance, each in the same direction. In this embodiment, the ratchet 18 may be configured to rotate such that the curved portion 70 of the teeth 19 passes over an opposing pawl, cog, rib, or tooth when the ratchet 18 is turned in the unrestricted direction. If the ratchet 18 is rotated in the restricted direction, however, a flat portion 72 of the teeth 19 may contact the pawl, cog, rib, or tooth and prevent further rotation. As the ratchet 18 rotates in the unrestricted direction, the affixed telescoping member 40 (and, optionally, the other telescoping members) turns as well, pushing the plunger 26 incrementally downward.

In an embodiment, the ratchet 18 is positioned within a ratchet support member 38. The ratchet support member 38 may be generally ring-shaped and may fit securely within the open top end 48 of the dispenser body 20, adjacent the rim of the dispenser body 20. In an embodiment, the dispenser body top end 48 may comprise one or more notches 62 which match up to notches 64 in the ratchet support member 38 such that the ratchet support member 38 can be aligned with and nested within the dispenser body 20. In an embodiment, the ratchet support member 38 comprises an internal seat 64 which receives the ratchet 18. The seat 64 may comprise a ledge which is lower than the rim of the dispenser body top end 48. The depth of the ledge may correspond to the depth of the ratchet 18. Similarly, the width of the seat 64 may be configured to at least partially support the wheel ratchet 18. The ratchet support member 38 may comprise a through hole through its center which allows the ratchet 18 to connect with and engage with the first telescoping member 40. In an embodiment, the ratchet support member 38 is sized and shaped to receive the ratchet 18 such that the ratchet 18 sits securely within the ratchet support member 38 and can turn either clockwise or counter-clockwise within the ratchet support member 38. In an embodiment, the teeth 19 of the ratchet 18 extend fully to contact and engage with the interior wall of the ratchet support member 38.

In an embodiment, the ratchet support member 38 has an internal sidewall 66 which is generally perpendicular to the seat 64 and generally parallel with the axis of the dispenser body 20. The internal sidewall 66 may be positioned entirely within the dispenser body 20, below its rim, or may extend partially above the rim of the dispenser body top end 48. The sidewall 66 of the ratchet support member 38 may comprise one or more internal pawls, cogs, ribs, or teeth. The internal pawls, cogs, ribs, or teeth may be any shape, size, or configuration as is known in the art. In an embodiment, the ratchet support member 38 comprises internal ribs 68. The ribs 68 may, in an embodiment, generally comprise a rounded triangular shape extending away from the internal sidewall 66, such that the ratchet teeth 19 may slide up and over the ribs 68 in a smooth motion. In other embodiments, the ribs 68 may be semicircular, semi-ovular, semi-elliptical, or may by curved in one direction.

In an embodiment, multiple ribs 68 are positioned along the sidewall 66 of the ratchet support member 38. In an embodiment the ratchet 18 comprises six teeth 19 and the ratchet support member 38 comprises ten ribs 68. In another embodiment the ratchet 18 comprises three teeth 19 and the ratchet support member 38 comprises eight ribs 68. In an embodiment, the ribs 68 are positioned equidistance about the circumference of the ratchet support member 38. In an embodiment, the ribs 68 are not positioned equidistance about the circumference of the ratchet support member 38. In an embodiment, the ribs 68 are positioned equidistance from one another, on opposite sides of the circumference of the ratchet support member 38. In an embodiment, the ribs 68 are positioned equidistance from one another, in an area comprising approximately ⅓ of the circumference of the ratchet support member 38. Any number or positioning of the ribs 68 and teeth 19 is contemplated herein.

In an embodiment, each audible click of the ratchet 18, which corresponds to the ratchet teeth 19 passing over an opposing pawl, cog, or tooth 68, comprises a fixed degree of rotation. For example, each click of the ratchet 18 may comprise a 15° rotation of the ratchet 18. In an embodiment, each click of the ratchet 18 also corresponds to a certain amount of sauce to be dispensed. For example, each click of the ratchet 18 may comprise a ⅙ oz. dosage of sauce. Thus, two clicks of the ratchet 18 may comprise a 30° rotation of the ratchet 18 and a ⅓ oz. dosage of the sauce. Likewise, three clicks of the ratchet 18 may comprise a 45° rotation of the ratchet 18 and a ½ oz. dosage of the sauce. Four clicks of the ratchet 18 may comprise a 60° rotation of the ratchet 18 and a ⅔ oz. dosage of the sauce. The dosage of the sauce may, therefore, be adjustable within a range.

In an embodiment, the dosage of the sauce or other ingredient may be adjustable between about ⅙ oz. to about 2 oz. In an embodiment, the dosage of the ingredient may be adjustable between about ⅓ oz. to about ⅔ oz. The dispenser 10 may be configured to provide any dosage known in the art, however.

In an embodiment, the ratchet 18 additionally comprises top ribs, pawls, cogs, or teeth 74 positioned on the top surface 76 of the wheel portion of the ratchet 18. The top ribs 74 may be any shape, size or configuration. In an embodiment, the top ribs 74 comprise a rectangle, half-cylinder, triangular prism, or trapezoidal prism. In an embodiment, the number of top ribs 74 corresponds to the number of teeth 19 on the ratchet 18. In an embodiment, the top ribs 74 extend outwardly from the center of the ratchet 18 toward the ratchet support member sidewall 66. In an embodiment, the top ribs 74 are positioned and/or aligned with the ratchet teeth 19. In an embodiment, the top ribs 74 are configured to engage with a dial 16.

The dial 16, in an embodiment, is positioned over the ratchet 18 and ratchet support member 38. The dial 16 is generally disk-shaped and is approximately the same diameter as the ratchet support member 38 and the dispenser body open end 48.

In an embodiment, the ratchet support member 38 comprises two or more raised portions 82, 83 along its rim. Raised portions 82, 83 may be generally parallel with the exterior sidewall of the ratchet support member 38 and the dispenser body 20. Between each raised portion 82, 83, along the circumference of the rim of the ratchet support member 38, is a distance 84. In an embodiment, the dial 16 has a rim 86 which extends perpendicular to the axis of the dispenser body 20. The rim 86 may have extensions 88 which extend outwardly from the rim. The extensions 88 may be square, rectangular, or any other shape known in the art. In an embodiment, when the dial 16 is positioned on top of the ratchet support member 38, the extensions 88 are positioned within the distance 84 between the raised portions of the ratchet support member 38. In this configuration, width of the extensions 88 may be less than the distance 84. The dial may be rotatable on the ratchet support member 38, but may be limited by the distance the extensions 88 can move within the distance 84. In an embodiment, when an extension 88 reaches the limit of the distance 84 and contacts a raised portion 82, 83 of the ratchet support member 38, the dial 16 cannot rotate any further. In an embodiment, the ratchet support member 38 comprises two or three raised portions 82, 83 and the dial 16 has a corresponding two or three extensions 88.

In an embodiment, the dial 16 may have a conical portion 90 which extends downwardly, parallel with the axis of the dispenser body 20, in the center of the disk, and aligns with and engages the central through hole in the ratchet 18. The dial 16 may additionally comprise one or more through holes or notches 80 in its top surface. The notches 80 may be sized and positioned to engage with the ratchet top ribs 74. That is, the notches 80 may be the same size as or larger than the ratchet top ribs 74. When the dial 16 is positioned on top of and engaged with the ratchet 18, the disk portion 92 of the dial 16 may sit substantially flat against the top surface of the ratchet 18 and the ratchet top ribs 74 may be positioned within the notches 80.

The dial 16 may also comprise one or more pawls, arms, or teeth 78 which are configured to engage with the ratchet top ribs 74. In an embodiment, the pawls 78 are located on the top, disk-like surface of the dial 16. The pawls 78 are, in an embodiment, adjacent the notches 80. In an embodiment, the each pawl 78 may be surrounded on three sides by a notch 80. For example, the notches 80 may be substantially C-shaped or U-shaped and the pawls 78 may comprise the interior portion of the "C" or "U". In an embodiment, each pawl 78 has an curved or angled end portion 96. The end portion 96 of the pawl 78 may be bent, curved, or angled downwardly, toward the dispenser body 20. In this configuration, the pawl 78 may pass over or slide over the top ribs 74 in one rotating direction, but the top ribs 74 will catch and prevent the pawl 78 from moving over or past the top ribs 74 in the opposite rotating direction.

In an embodiment, a separate audible click can be heard when the pawl 78 moves over or past the top ribs 74. In this embodiment, the audible click may be an indication to the user that the dispenser 10 has been reset to its starting position, ready for its next dispensing application.

In an embodiment, the dial 16 may comprise various gripping mechanisms (ridges or ribs, for example) about its rim, designed to allow the user to turn the dial 16 more easily in each direction. The topmost edge of the dial may be flat or may scalloped, in an embodiment. Any design configuration known in the art may be utilized for the gripping element of the dial 16.

In an embodiment, the dispenser 10 comprises multiple dials 16 and multiple ratchets 18, each dial and each ratchet configured to be interchangeable. In this embodiment a first dial and ratchet may provide a particular dosage of sauce. A second, interchangeable dial and ratchet may provide a slightly smaller or larger dosage of sauce. A third, interchangeable dial and ratchet may provide an even smaller or larger dosage of sauce. In this embodiment, the top ring 12 may be removed and the dial 16 and ratchet 18 exchanged before, during, or after the dispensing process. The top ring 12 may then be replaced and the dispensing process commenced or recommenced. In an embodiment, the interchangeable ratchets each have fewer or more teeth than the other and/or teeth that are further apart or closer to one another. In an embodiment, the interchangeable dials coordinate with particular ratchets. In an embodiment, each dial and ratchet is labeled or color coded so that the user inserts the dial and ratchet that match.

In an embodiment, the top ring 12 may be fitted over the dial 16 such that it retains the dial 16 and the other dispenser 10 components within the dispenser body 20. In an embodiment, the top ring 12 is screwed onto the dispenser body 20.

In an embodiment, the dispenser 10 is configured to receive a flexible pouch. The flexible pouch may be single-ply or multi-ply and may be made from any material(s) known in the art. In an embodiment, the pouch has barrier properties, preventing the ingress or egress of gases, fluids, or other particles. The flexible pouch may be sized and shaped to fit within the dispenser body 20, particularly when the pouch contains a food or sauce product. In an embodiment, the flexible pouch is generally cylindrical in shape when containing a food or sauce product. In an embodiment, the flexible pouch has a nozzle, spout or valve on one end thereof. The nozzle or valve preferably allows the contents of the pouch to be dispensed in controlled quantities upon pressure exerted by the plunger 26. In a particular embodiment, the pouch comprises a spout which has an adhesive-fixed closure. In this embodiment, adhesive is positioned between two opposing faces of the pouch in a spout area of the pouch, such as in a corner or end point of the pouch. The adhesive may be a resealable adhesive or a pressure sensitive adhesive. In this embodiment, when a sufficient amount of pressure is exerted on the pouch by the plunger 26, the adhesive between the two film faces fails and the spout pops open, releasing the sauce through the spout. In this embodiment, a spout cap 14 may be provided.

In an embodiment, the pouch may have an elongated portion which is manually clipped or cut by the user in order to create an open spout for the release of the pouch contents. In this embodiment, the pouch spout may or may not have a resealable adhesive or pressure sensitive adhesive disposed within the elongated spout portion.

In an embodiment wherein the midsection 56 is elliptical, the dispenser body bottom wall 28 may also be elliptical. The dispenser body 20 may further comprise a circumferential wall 94 which is affixed to the dispenser body 20 and positioned below the dispenser body bottom wall 28 (opposite the open top end 48). The circumferential wall 94 may be generally cylindrical in shape or may be gradually angled to comprise a cylindrical shape at its lower end. The circumferential wall 94 may comprise threads on its outer surface and may be adapted to engage the internal threads of the spout cap 14.

The spout cap 14 may help to control the dispensing features of the dispenser contents and prevent dripping after the appropriate quantity of sauce has been dispensed. The spout cap 14 may be generally disk or cap-shaped and may have internal threads which engage with external threads on the bottom end of the dispenser body 20, opposite the open top end 48. The spout cap 14 may be an overcap which is disposed over the through hole 30 in the dispenser body bottom wall 28.

The spout cap 14 may comprise one or more through holes 22. In the depicted embodiment, the spout cap 14 comprises five through holes 22, but any number of through holes 22 is contemplated herein. A larger number of dispensing holes 22 may help to ensure a more even distribution of the sauce, rather than dispensing of the sauce solely through a central hole. In any case, the dispensing holes 22 in the spout cap 14 may be fitted with valves which, upon the exertion of internal pressure, open and dispense sauce and, upon the release of internal pressure, close again, preventing or limiting any dripping of the sauce. Any valve known in the art may be utilized in this embodiment. The valve may be a flexible plastic valve, in an embodiment.

In other embodiments, the flexible pouch comprises a valve spout itself which, upon the exertion of internal pressure, opens and dispenses sauce and, upon the release of internal pressure, closes again, resealing the flexible pouch. In such an embodiment, the spout cap 14 may be omitted entirely. Any valve spout known in the art may be utilized in this embodiment such as, for example, those disclosed in U.S. Pat. Nos. 6,547,108 and 7,258,254, which are incorporated by reference herein in their entirety.

Operation

In an embodiment, a flexible pouch containing the ingredient to be dispensed is inserted into the dispenser 10. The top ring 12 may be removed from the dispenser 10 and the dial 16, ratchet 18, ratchet support member 38, telescoping members 40, 42, 44, 45, and the plunger 26 may be removed from the dispenser body 20, through the open top end 48, optionally held together as one unitary structure. The flexible pouch may then be inserted into the dispenser body 20, through the open top end 48. The spout of the flexible pouch may be positioned within the through hole 30 in the dispenser body bottom wall 28. If a spout cap 14 is utilized, it may be screwed in place (or otherwise affixed to the dispenser 10) before or after insertion of the pouch. The telescoping members 40, 42, 44, 45 may be turned upside down such that the gravitational pull retracts each telescoping member into its adjacent, larger telescoping member and the telescoping mechanism is in its fully retracted position. The dial 16, ratchet 18, ratchet support member 38, telescoping members 40, 42, 44, 45, and the plunger 26 may then be inserted back into the dispenser 10 and the top ring may be replaced and screwed into position. The dispenser 10 is then ready to be utilized for the dispensing of sauces.

In operation, the dispenser is provided in a starting position, with the dial extension 88 adjacent a first raised portion 82 of the ratchet support member 38. The top ribs 74 of the ratchet 18 are positioned within the notches 80. The dial 16 is then rotated clockwise. In an embodiment, the dial pawl 78 is prevented from moving over or past the top ribs 74 on the ratchet face. Therefore, the dial 16 pushes the ratchet 18 in the clockwise direction by pushing the dial pawls 78 against the ratchet top ribs 74, rotating the ratchet 18 itself.

As the ratchet 18 rotates in the clockwise direction, one or more of the telescoping members 40, 42, 44, 45 is also rotated in the clockwise direction and is extended incrementally downwardly within the dispenser body 20, toward the dispenser bottom wall 28. The plunger 26, which is attached to the end of the telescoping members 40, 42, 44, 45 nearest the dispenser bottom wall 28, is also advanced an incremental distance within the dispenser body 20, toward the dispenser bottom wall 28. The movement of the plunger 26 puts pressure on the flexible pouch within the dispenser 10. The flexible pouch relieves the pressure being exerted upon it by dispensing an amount of sauce through its spout end, which may be positioned within the dispenser bottom wall hole 30 or inverted funnel. The sauce is pushed, dispensed, or extruded through the nozzle or spout of the flexible pouch and, in an embodiment, is then pushed, dispensed, or extruded through the spout cap 14, via the spout cap holes 22. The spout cap holes 22 may comprise flexible valves.

The invention ensures a measured and consistent amount of the sauce is dispensed from the dispenser 10 during each application. As the ratchet 18 rotates in the clockwise direction due to the manual rotation of the dial 16 in the clockwise direction, its teeth 19 are pushed toward and then slide up and over the ribs 68 on the internal sidewall 66 of the ratchet support member 38. When this occurs, an audible click is heard. After the audible click, the dial 16 may be continued to be rotated in the clockwise direction and additional audible clicks may be heard. In an embodiment, up to four audible clicks may be observed.

Each audible click may be associated with a particular degree of rotation of the dial 16 and ratchet 18 (15°, for example), a particular incremental movement of one or more of the telescoping members and the plunger 26 downwardly (1/16", for example) and a particular dosage of the ingredient in the pouch (1/6 oz., for example). Thus, if the user desires to dispense 1/3 oz. of sauce, he may turn the dial 16 in a clockwise direction until two (2) clicks are observed. If a user desires to dispense 2/3 oz. of sauce, he may turn the dial 16 in a clockwise direction until four (4) clicks are observed.

In an embodiment, the dial 16 may be prevented from further rotation in the clockwise direction at a particular point. Namely, once the dial extension 88 moves away from the first raised portion 82 and comes into contact with the second raised portion 83 of the ratchet support member 38 (which corresponds, in an embodiment, to the maximum allowable number of clicks), the dial cannot be rotated further in the clockwise direction. Said another way, the dial 16 is limited in its movement in either rotation direction (clockwise and counterclockwise) by the distance 84 between the first raised portion 82 and the second raised portion 83. The dial extension 88 will contact the first raised portion 82 in one rotation direction and the second raised portion 83 in the other rotation direction, preventing further movement in either direction.

Once the desired dosage of sauce has been dispensed, regardless of whether the dial extension 88 has contacted the second raised portion 83 of the ratchet support member 38, the user must rotate the dial 16 in the counterclockwise direction to reset the dispenser. The teeth 19 of the ratchet 18, however, cannot move up and over the ribs 68 in the counterclockwise direction. For example, in an embodiment, a flat portion 72 of the teeth 19 may contact the ribs 68 and prevent further rotation in the counterclockwise direction. As a result, the ratchet 18 remains in position while the dial 16 turns counterclockwise, thereby also maintaining the telescoping members and the plunger 26 in their position. In this embodiment, only the dial 16 turns in the counterclockwise direction.

As the dial 16 rotates counterclockwise, the pawls 78 approach one or more top ribs 74. When the dial pawls 78 move up over and the top ribs 74, another audible click can be heard. This audible click indicates to the user that the dial 16 has been reset and the dispenser is ready to dispense another dosage of sauce.

This process can be repeated quickly and systematically. While holding the dispenser in a dispensing position, a user turns the dial 16 clockwise until the desired number of clicks are heard based upon the desired dosage, and then rotates the dial 16 in the counterclockwise direction until an additional click is heard to reset the dial. The user then repeats the process. Plates or food products may be lined up and a user may administer the desired dosage in an assembly line fashion using this repeating process.

While the rotation directions have been referred to herein as clockwise as a first rotation and counterclockwise as a second rotation, it should be understood that either direction may be utilized as a first or second rotation direction in the invention. In an embodiment, the first rotation direction (dispensing of the sauce) should be opposite the second rotation direction (resetting of the dial).

After the dispenser 10 is emptied of all sauces, the top ring 12 may be removed from the dispenser 10 and the dial 16, ratchet 18, ratchet support member 38, telescoping members 40, 42, 44, 45, and the plunger 26 may be removed from the dispenser body 20, through the open top end 48, optionally maintained together as one unitary structure. The empty flexible pouch may then be removed from the dispenser body 20, through the open top end 48 and a new flexible pouch may be inserted. The empty flexible pouch may be discarded. The telescoping members 40, 42, 44, 45 may be turned upside down such that the gravitational pull retracts each telescoping member into its adjacent, larger telescoping member. The dial 16, ratchet 18, ratchet support member 38, telescoping members 40, 42, 44, 45, and the plunger 26 may then be inserted back into the dispenser 10 and the top ring may be replaced and screwed into position. The dispenser 10 is then ready to be utilized for the dispensing of sauces once again.

Advantageously, the present invention provides a dispenser 10 having a shorter total dispenser body 20 length as compared with standard caulk gun style dispenser due, in part, to the telescoping features of the invention. The dispenser of the present invention does not comprise a long caulk gun-type rod, which can be cumbersome and difficult to store in a commercial kitchen. In addition, the dispenser 10 is designed to receive flexible pouches, not cartridges, which are easier to store and create less waste. That being said, the present invention could be adapted to be used in connection with sauce cartridges as well, which is contemplated herein. The present invention also provides a dispenser which allows a user to adjust the amount to be dispensed, on demand, and without interchanging any equipment, cartridges, or pouches. This improves the customer experience, allowing for more customization of food products. This additionally reduces the time needed for food preparation and avoids or reduces the necessity of having multiple dispensers of different application volumes for a single product. Overall, the inventive dispenser is more versatile and convenient, requires less storage space, is more maneuverable, and creates less waste than a traditional sauce dispenser. It also provides an improved ability to customize food orders with ease and without time lost to equipment changes.

The dispenser 10 and its component parts described herein may be formed from any material known in the art, such as papers, plastics, or metals. In an embodiment, the dispenser 10 and its component parts each comprise injection molded plastics. In an embodiment, the telescoping members comprise a metal composition. In an embodiment, the dispenser body 20 may be translucent or transparent, or may comprise a translucent or transparent window which allows the user to determine how approximately many sauce portions remain in the dispenser.

As discussed herein, each of the component parts of the invention is described separately, but it should be understood that the component parts may be permanently affixed to one another in any configuration. Likewise, the dispenser may comprise one unitary structure which comprises the dial, ratchet, ratchet support member, telescoping members, and plunger and/or any combination thereof. For example, the ratchet, ratchet support member, and telescoping members may comprise one unitary structure.

The accompanying figures are provided for explanatory purposes and may not show all components described herein with respect to embodiments of the dispenser. In addition, those components that are illustrated are not necessarily drawn to scale. Thus, certain layers that are shown as the same thickness or thinner than other layers may actually be thicker than other layers, and so on.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dispensing device comprising:

a. an elongated dispenser body wherein the dispenser body i. is elliptical in cross-section through its midsection, ii. has an open top end which is circular in cross-section, and iii. has a dispensing bottom end opposite the top end;

b. a cylindrical ratchet support member which is removably disposed within the open top end of the dispenser body, wherein the ratchet support member comprises a through hole one and or more ribs disposed on the inside of its circumferential sidewall;

c. a wheel-shaped ratchet which is removably disposed within the ratchet support member, wherein
   i. the ratchet has radially extending teeth which are configured to engage with the ratchet support member ribs,
   ii. the ratchet configuration allows rotary motion in a first direction over the ribs,
   iii. the ratchet configuration prevents rotary motion in a second, opposite direction past a point defined by the ribs,
   iv. the ratchet comprises ribs disposed on the top surface of the ratchet wheel;

d. a dial which is removably disposed on top of the ratchet, wherein the dial comprises one or more notches which are disposed over the ratchet top ribs and one or more pawls which are adjacent the notches and configured to engage with the ratchet top ribs, and wherein
   i. the pawl and rib configuration allows rotary motion in a direction which is opposite the first ratchet direction, over the ratchet top ribs, and
   ii. the pawls cannot move over the ratchet top ribs in the first ratchet direction;

e. a plurality of telescoping members of varying diameters, wherein
   i. a telescoping member with a smaller diameter may be nested within the interior of an adjacent telescoping member with a larger diameter,
   ii. one of the telescoping members is affixed to the ratchet, and
   iii. one or more of the telescoping members may be extended a distance through rotation of the ratchet; and f. an elliptical plunger affixed to the end of the telescoping member opposite the telescoping member which is affixed to the ratchet, wherein the plunger is sized substantially similarly to an interior surface of the dispenser body midsection and it disposed within the dispenser body midsection.

2. The dispensing device of claim 1, wherein the dispensing bottom end comprises a bottom wall which has at least one through hole.

3. The dispensing device of claim 2 wherein the plunger is adjacent the dispenser bottom wall when the telescoping members are fully extended.

4. The dispensing device of claim 1 wherein the open top end is configured to receive a retaining ring which retains the ratchet support member, ratchet, dial, telescoping members, and plunger within the dispenser body.

5. The dispensing device of claim 1 comprising three telescoping members.

6. The dispensing device of claim 1 comprising four telescoping members.

7. The dispensing device of claim 1, wherein one or more of the telescoping members comprise threads on their inner and outer surfaces.

8. The dispensing device of claim 7 wherein the outer threads of the telescoping member with a smaller diameter engage with the inner threads of the telescoping member with a larger diameter.

9. The dispensing device of claim 1 wherein the telescoping members are cylindrical.

10. The dispensing device of claim 1 wherein the telescoping member with the smallest diameter is affixed to the ratchet and the telescoping member with the largest diameter is affixed to the plunger.

11. The dispensing device of claim 1 wherein an audible click is created when the ratchet teeth move over the ratchet support member ribs.

12. The dispensing device of claim 1 wherein multiple ratchet support ribs are provided and each is equidistance from the other.

13. The dispensing device of claim 1 wherein a series of multiple ratchet support ribs are provided and each rib within the series is equidistance from the other, with the exception of the distance between the last rib and the first rib.

14. The dispensing device of claim 1 wherein each multiple ratchet support rib corresponds to a fixed degree of rotation.

15. The dispensing device of claim 1 wherein each multiple ratchet support rib corresponds to a certain amount of a product to be dispensed.

16. The dispensing device of claim 1 wherein the number of ratchet top ribs corresponds to the number of teeth on the ratchet.

17. The dispensing device of claim 1 wherein the ratchet support member comprises two or more raised vertical portions along its rim and the dial comprises two or more horizontal extensions that are disposed within the distance between the raised vertical portions of the ratchet support member.

18. The dispensing device of claim 17 wherein the dial is rotatable on the ratchet support member and its rotation is limited by the distance the dial extensions can move between the raised vertical portions on the ratchet support member.

19. The dispensing device of claim 1 wherein the dispensing device is configured to receive a flexible pouch containing a product to be dispensed.

20. The dispensing device of claim 19 wherein the flexible pouch has a nozzle, spout or valve on one end thereof.

21. The dispensing device of claim 20 wherein the dispensing bottom end is configured to receive the nozzle, spout or valve of the spout.

22. The dispensing device of claim 20 wherein the dispensing bottom end comprises a through hole which is configured to receive the nozzle, spout or valve of the spout.

23. The dispensing device of claim 1 additionally comprising a spout cap disposed over the dispensing bottom end.

24. The dispensing device of claim 23 wherein the spout cap comprises one or more through holes.

25. The dispensing device of claim 24 wherein each of the one or more through holes comprises a flexible valve.

26. The dispensing device of claim 1 wherein an audible click is created when the dial pawls move over the ratchet top ribs.

* * * * *